US009894953B2

(12) United States Patent
Szalkowski et al.

(10) Patent No.: US 9,894,953 B2
(45) Date of Patent: Feb. 20, 2018

(54) HELMET RETENTION SYSTEM

(71) Applicant: Intellectual Property Holdings, LLC, Cleveland, OH (US)

(72) Inventors: Ron Szalkowski, Lakewood, OH (US); Bryan Stephen Javorek, Lyndhurst, OH (US); Joshua Schmidt, Lakewood, OH (US)

(73) Assignee: INTELLECTUAL PROPERTY HOLDINGS, LLC, Cleveland, OH (US)

( * ) Notice: Subject to any disclaimer, the term of this patent is extended or adjusted under 35 U.S.C. 154(b) by 777 days.

(21) Appl. No.: 13/777,270

(22) Filed: Feb. 26, 2013

(65) Prior Publication Data

US 2014/0096310 A1 Apr. 10, 2014

Related U.S. Application Data

(60) Provisional application No. 61/709,437, filed on Oct. 4, 2012.

(51) Int. Cl.

| | |
|---|---|
| ***A42B 3/00*** | (2006.01) |
| ***A42B 3/08*** | (2006.01) |
| ***A42B 3/14*** | (2006.01) |

(52) U.S. Cl.

CPC ..... *A42B 3/08* (2013.01); *A42B 3/145* (2013.01); *A42B 3/085* (2013.01)

(58) Field of Classification Search

CPC A42B 3/147; A42B 3/04; A63B 71/10; A41F 15/007

USPC ..... 2/420, 421, 425, 416–419, 411

See application file for complete search history.

(56) References Cited

U.S. PATENT DOCUMENTS

| | | | |
|---|---|---|---|
| 666,130 | A | 1/1901 | Cole |
| 957,394 | A | 5/1910 | Thoma |
| 1,012,597 | A | 12/1911 | Church |
| 1,539,283 | A | 5/1925 | Staats-Oels |
| 1,552,965 | A | 9/1925 | Smith |

(Continued)

FOREIGN PATENT DOCUMENTS

| | | |
|---|---|---|
| CA | 2598015 | 8/2006 |
| CA | 2663728 | 9/2008 |

(Continued)

OTHER PUBLICATIONS

Patent Translate Powered by EPO and Google, Description Translation of JP2006188771, May 2016, Espacenet, pp. 1-15.*

(Continued)

*Primary Examiner* — Jameson Collier
*Assistant Examiner* — Brieanna Szafran
(74) *Attorney, Agent, or Firm* — Calfee, Halter & Griswold LLP

(57) ABSTRACT

The present application discloses a helmet, a retention system for a helmet, and a method of adjusting a helmet. In certain embodiments, the helmet comprises a helmet shell and a retention system attached to the helmet shell. The retention system generally comprises a rear portion connected to the rear of the helmet shell, at least one strap extending from the rear portion to a front portion of the helmet shell, and an adjustment device attached to the rear portion and configured to selectively adjust the length of the strap between the rear portion and the front portion of the helmet shell.

24 Claims, 10 Drawing Sheets

(56) References Cited

U.S. PATENT DOCUMENTS 1,560,825 A 11/1925 Kelticka
1,958,050 A 5/1934 Koppelman
2,074,331 A 3/1937 Haider
2,090,881 A 8/1937 Wilson
2,221,310 A 11/1940 Gazelle
2,275,575 A 3/1942 Vrooman
2,285,335 A 6/1942 Hurt
2,303,744 A 12/1942 Jacobs
2,311,373 A 2/1943 Durning
2,318,077 A 5/1943 Jonas
2,346,161 A 4/1944 Grant
2,349,907 A 5/1944 Kos
2,433,012 A 12/1947 Zalicovitz
2,434,641 A 1/1948 Burns
2,649,019 A * 8/1953 Hartline ..... A42B 3/04 2/453
2,711,033 A 6/1955 Dick
2,739,093 A 3/1956 Bull
2,759,186 A 8/1956 Dye
2,772,196 A 11/1956 Pooley
2,776,452 A 1/1957 Chavannes
2,983,056 A 5/1961 Murawski
3,018,015 A 1/1962 Agriss et al.
3,026,231 A 3/1962 Chavannes
3,039,109 A 6/1962 Simpson
3,086,899 A 4/1963 Smith et al.
3,088,539 A 5/1963 Mathues et al.
3,099,043 A 7/1963 Held
3,124,807 A 3/1964 Frenkel et al.
3,142,599 A 7/1964 Chavannes
3,144,247 A 8/1964 Szonn et al.
3,153,792 A 10/1964 Marietta
3,160,963 A 12/1964 Aaskov
3,186,013 A 6/1965 Glassman et al.
3,195,686 A 7/1965 Johnson
3,231,454 A 1/1966 Williams
3,242,500 A 3/1966 Derr
3,251,076 A 5/1966 Burke
3,280,410 A 10/1966 Propst et al.
3,327,334 A 6/1967 Wilmanns et al.
3,342,666 A 9/1967 Hull
3,366,971 A 2/1968 Scherz
3,378,888 A 4/1968 Robertson
3,425,061 A 2/1969 Webb
3,447,163 A 6/1969 Bothwell et al.
3,484,835 A 12/1969 Trountine et al.
3,500,472 A 3/1970 Castellani
3,500,475 A 3/1970 Neal
3,507,727 A 4/1970 Marshack
3,508,992 A 4/1970 Chavannes et al.
3,514,156 A 5/1970 Fields
3,525,663 A 8/1970 Hale
3,538,628 A 11/1970 Einstein, Jr.
3,575,781 A 4/1971 Pezely
3,600,714 A 8/1971 Cade
3,608,215 A 9/1971 Fukuoka
3,609,764 A 10/1971 Morgan
3,618,144 A 11/1971 Frey et al.
3,633,228 A 1/1972 Zysman
3,668,056 A 6/1972 Hayes, Jr.
3,668,704 A 6/1972 Conroy
3,673,609 A 7/1972 De Simone
3,679,166 A 7/1972 Sturhan
3,684,235 A 8/1972 Schupbach
3,709,967 A 1/1973 Held, Jr.
3,713,640 A 1/1973 Margan
3,716,614 A 2/1973 Okamoto et al.
3,729,744 A 5/1973 Rappleyea
3,747,968 A 7/1973 Hornsby
3,761,959 A 10/1973 Dunning
3,766,669 A 10/1973 Pearsall
3,782,767 A 1/1974 Moore
3,783,450 A 1/1974 O'Connor
3,784,985 A 1/1974 Conroy
3,806,950 A 4/1974 Spencer-Foote
3,837,991 A 9/1974 Evans
3,849,801 A 11/1974 Holt et al.
3,853,221 A 12/1974 Boyd
3,857,144 A 12/1974 Bustin
3,863,909 A 2/1975 Weber
3,871,636 A 3/1975 Boyle
3,872,511 A 3/1975 Nichols
3,877,076 A 4/1975 Summers
3,882,547 A 5/1975 Morgan
3,884,862 A 5/1975 King
3,895,456 A 7/1975 Fabre
3,900,222 A 8/1975 Muller
3,911,187 A 10/1975 Raley
3,926,463 A 12/1975 Landwehr
3,928,881 A 12/1975 Bente
3,933,387 A 1/1976 Salloum et al.
3,940,529 A 2/1976 Hepford et al.
3,940,811 A 3/1976 Tomikawa et al.
3,952,358 A 4/1976 Fukuoka
3,971,583 A 7/1976 Komahuser
D241,228 S 8/1976 Boduch
3,994,020 A 11/1976 Villari
3,995,901 A 12/1976 Filbert, Jr. et al.
3,997,207 A 12/1976 Norlin
3,999,220 A 12/1976 Keltner
4,022,505 A 5/1977 Saczawa, Jr.
4,023,213 A 5/1977 Rovani
4,029,350 A 6/1977 Goupy et al.
4,029,534 A 6/1977 Bocks et al.
4,038,700 A 8/1977 Gyory
4,044,399 A 8/1977 Morton
4,044,479 A 8/1977 Brutting
4,064,565 A 12/1977 Griffiths
4,067,063 A 1/1978 Ettinger
4,075,717 A 2/1978 Lemelson
4,077,393 A 3/1978 Mattson
4,099,759 A 7/1978 Kornhauser
4,101,983 A 7/1978 Dera et al.
4,106,745 A 8/1978 Carrow
4,110,857 A 9/1978 Banister
4,114,197 A 9/1978 Morton
4,134,156 A 1/1979 Gyory
4,151,661 A 5/1979 Namba
4,154,469 A 5/1979 Goupy et al.
4,154,489 A 5/1979 Lyman
4,170,078 A 10/1979 Moss
4,187,620 A 2/1980 Selner
4,190,276 A 2/1980 Hirano
4,192,699 A 3/1980 Lewicki et al.
4,213,202 A 7/1980 Larry
4,223,455 A 9/1980 Vermeulen
4,223,456 A 9/1980 Cohen
4,236,326 A 12/1980 Inohara
4,239,106 A 12/1980 Aileo
4,239,476 A 12/1980 Somberg
4,251,932 A 2/1981 Love
4,262,433 A 4/1981 Hagg
4,267,648 A 5/1981 Weisz
4,279,038 A 7/1981 Bruckner et al.
4,287,613 A 9/1981 Schultz
4,288,399 A 9/1981 Siedenstrang et al.
4,290,149 A 9/1981 Aileo
4,297,797 A 11/1981 Meyers
4,299,038 A 11/1981 Epple
4,302,892 A 12/1981 Adamik
4,305,212 A 12/1981 Coorner
4,307,471 A 12/1981 Lovell
4,321,989 A 3/1982 Meinzer
4,338,371 A 7/1982 Dawn et al.
4,342,157 A 8/1982 Gilbert
4,342,158 A 8/1982 McMahon
4,345,338 A 8/1982 Frieder, Jr. et al.
4,347,637 A 9/1982 Ardito
4,352,484 A 10/1982 Gertz
4,355,792 A 10/1982 Fukuda
4,356,642 A 11/1982 Herman
D267,287 S 12/1982 Gooding
D267,831 S 2/1983 Sucato
4,370,754 A 2/1983 Donzis

(56) References Cited

U.S. PATENT DOCUMENTS 4,372,058 A 2/1983 Stubblefield
4,377,042 A 3/1983 Bauer
4,391,048 A 7/1983 Lutz
4,398,357 A 8/1983 Batra
4,400,483 A 8/1983 Siedenstrang et al.
4,400,894 A 8/1983 Ehrlich
4,413,856 A 11/1983 McMahan et al.
4,418,483 A 12/1983 Fujita
4,423,000 A 12/1983 Teraoka
4,428,306 A 1/1984 Dresen et al.
4,432,099 A 2/1984 Grick et al.
4,439,936 A 4/1984 Clarke et al.
4,445,283 A 5/1984 Meyers
4,449,307 A 5/1984 Stubblefield
4,453,271 A 6/1984 Donzis
4,455,765 A 6/1984 Sjosward
4,458,430 A 7/1984 Peterson
4,460,205 A 7/1984 Glance
4,461,044 A * 7/1984 Reiterman ..... A42B 3/08 2/421
4,472,472 A 9/1984 Schultz
4,494,320 A 1/1985 Davis
4,497,123 A 2/1985 Ehrlich
4,510,702 A 4/1985 Ehrlich, Jr.
4,513,449 A 4/1985 Donzis
4,518,643 A 5/1985 Francis
4,523,393 A 6/1985 Inohara
4,534,068 A 8/1985 Mitchell et al.
4,535,553 A 8/1985 Derderian et al.
4,538,301 A 9/1985 Sawatzki et al.
4,538,366 A 9/1985 Norton
4,546,555 A 10/1985 Spademan
4,553,342 A 11/1985 Derderian et al.
4,558,470 A 12/1985 Mitchell et al.
4,562,651 A 1/1986 Frederick et al.
4,566,678 A 1/1986 Anderson
4,566,137 A 2/1986 Gooding
4,578,296 A 3/1986 Miyazaki
4,586,200 A 5/1986 Poon
4,601,367 A 7/1986 Bongers
4,614,000 A 9/1986 Mayer
4,616,431 A 10/1986 Dassler
4,619,055 A 10/1986 Davidson
4,624,061 A 11/1986 Wezel et al.
4,627,114 A 12/1986 Mitchell
4,631,221 A 12/1986 Disselbeck et al.
4,635,384 A 1/1987 Huh et al.
4,635,981 A 1/1987 Friton
4,642,814 A 2/1987 Godfrey
4,657,716 A 4/1987 Schmidt
4,666,130 A 5/1987 Denman
4,667,423 A 5/1987 Autry et al.
4,670,995 A 6/1987 Huang
4,672,754 A 6/1987 Ehrlich
4,676,010 A 6/1987 Cheskin
4,680,875 A 6/1987 DAnieli
4,695,496 A 9/1987 Lee
4,700,403 A 10/1987 Vacanti
4,703,879 A * 11/1987 Kastendieck ..... A42B 3/04 2/422
4,704,746 A 11/1987 Nava
4,710,984 A 12/1987 Asper
4,720,261 A 1/1988 Fishwick et al.
4,722,131 A 2/1988 Huang
4,724,549 A 2/1988 Herder et al.
4,730,402 A 3/1988 Norton et al.
4,739,762 A 4/1988 Palmaz
4,741,114 A 5/1988 Stubblefield
4,753,021 A 6/1988 Cohen
4,759,136 A 7/1988 Stewart et al.
4,763,426 A 8/1988 Polus et al.
4,766,614 A 8/1988 Cantwell et al.
4,768,295 A 9/1988 Ito
4,798,009 A 1/1989 Colonel et al.
4,808,469 A 2/1989 Hiles
4,815,221 A 3/1989 Diaz
4,817,304 A 4/1989 Parker et al.
4,823,483 A 4/1989 Chapncik
4,831,750 A 5/1989 Muller
4,856,208 A 5/1989 Zaccaro
4,838,606 A 6/1989 Furubayashi et al.
4,842,931 A 6/1989 Zook
4,843,741 A 7/1989 Yung-Mao
4,844,213 A 7/1989 Travis
4,845,786 A 7/1989 Chiarella
4,845,861 A 7/1989 Armenak Moundjian
4,845,863 A 7/1989 Yung-Mao
4,852,704 A 8/1989 Brockenbrough
4,853,980 A 8/1989 Zarotti
4,856,833 A 8/1989 Beekman
4,858,343 A 8/1989 Flemming
4,858,606 A 8/1989 Hamlin
4,872,220 A 10/1989 Haruvy et al.
4,876,053 A 10/1989 Norton
4,883,299 A 11/1989 Bonar
4,887,369 A 12/1989 Bailey
4,890,877 A 1/1990 Ashtiani-Zarandi et al.
4,899,467 A 2/1990 Mackey
4,901,987 A 2/1990 Greenhill et al.
4,904,008 A 2/1990 Glance
4,905,382 A 3/1990 Yung-Mao
4,909,661 A 3/1990 Ivey
4,912,861 A 4/1990 Huang
4,916,759 A 4/1990 Arai
4,918,841 A 4/1990 Turner
4,920,663 A 5/1990 Flemming
4,922,630 A 5/1990 Robinson
4,922,631 A 5/1990 Anderie
4,923,650 A 5/1990 Antoon, Jr. et al.
4,925,224 A 5/1990 Smiszek
4,930,231 A 6/1990 Liu
4,931,115 A 6/1990 Pajunen
4,934,071 A 6/1990 Virgini
4,941,701 A 7/1990 Loren
4,951,986 A 8/1990 Hanfusa et al.
D310,893 S 9/1990 Broersma
4,969,680 A 11/1990 Shimoda
4,970,729 A 11/1990 Shimazaki
4,972,611 A 11/1990 Swartz
4,984,320 A 1/1991 Curley, Jr. et al.
4,987,609 A 1/1991 Zahn
4,993,173 A 2/1991 Gardener
4,999,931 A 4/1991 Welygan et al.
5,011,642 A 4/1991 Welygan et al.
5,014,449 A 5/1991 Richard et al.
5,014,691 A 5/1991 Cueman et al.
5,016,417 A 5/1991 Mentken
5,025,504 A 6/1991 Benston et al.
5,027,803 A 7/1991 Scholtz et al.
5,030,501 A 7/1991 Colvin et al.
5,033,593 A 7/1991 Kazuhito
5,035,009 A 7/1991 Wingo, Jr. et al.
5,035,758 A 7/1991 Degler et al.
5,042,174 A 8/1991 Nichols
5,042,175 A 8/1991 Romen et al.
5,042,176 A 8/1991 Zhang et al.
5,042,859 A 8/1991 Zhang et al.
5,044,096 A 9/1991 Polegato
5,046,267 A 9/1991 Kilgore et al.
5,048,203 A 9/1991 Kling
5,056,162 A 10/1991 Tirums
5,058,212 A 10/1991 Kamata
5,066,400 A 11/1991 Rocklitz et al.
5,068,922 A 12/1991 Zahn
5,083,320 A 1/1992 Halstead
5,083,361 A 1/1992 Rudy
5,086,033 A 2/1992 Armor et al.
5,092,060 A 3/1992 Frachey et al.
5,093,938 A 3/1992 Kamata
5,097,607 A 3/1992 Fredericksen
5,098,124 A 3/1992 Breed et al.
5,124,191 A 6/1992 Seksaria
5,131,174 A 7/1992 Drew et al.
5,150,935 A 9/1992 Glance et al.

(56) References Cited

U.S. PATENT DOCUMENTS 5,165,990 A 11/1992 Nakano
5,168,576 A 12/1992 Krent et al.
5,175,889 A 1/1993 Infusino
5,204,998 A 4/1993 Liu
5,224,277 A 7/1993 Sang Do
5,235,715 A 8/1993 Donzis
5,244,745 A 9/1993 Seksaria
5,263,203 A 11/1993 Kraemer et al.
5,271,103 A 12/1993 Darnell
5,274,846 A 1/1994 Kolsky
5,289,890 A 1/1994 Wydra
5,282,288 A 2/1994 Henson
5,324,460 A 6/1994 Briggs
5,330,249 A 7/1994 Weber et al.
5,376,318 A 12/1994 Ho
5,409,200 A 4/1995 Zingher et al.
5,421,035 A 6/1995 Klose et al.
5,423,087 A 6/1995 Krent et al.
5,439,733 A 8/1995 Paire
D364,487 S 11/1995 Tutton et al.
5,477,558 A 12/1995 Volker et al.
5,493,791 A 2/1996 Kramer
5,543,194 A 8/1996 Rudy
5,545,128 A 8/1996 Hayes
5,551,094 A * 9/1996 Navone ..... A42B 3/08 2/418
5,555,584 A 9/1996 Moore et al.
5,572,749 A 11/1996 Ogden
5,572,804 A 11/1996 Skaja et al.
5,581,818 A 12/1996 Lorenzi et al.
5,581,819 A * 12/1996 Garneau ..... A42B 3/085 2/421
5,588,165 A 12/1996 Fromme
5,591,379 A 1/1997 Shores
5,595,003 A 1/1997 Snow
5,598,588 A 2/1997 Lee
5,611,153 A 3/1997 Fisher et al.
5,655,226 A 8/1997 Williams
5,669,079 A 9/1997 Morgan
5,734,994 A 4/1998 Rogers
5,741,568 A 4/1998 Rudy
5,766,704 A 6/1998 Allen et al.
5,891,372 A 4/1999 Besset et al.
5,913,412 A 6/1999 Huber et al.
5,915,537 A 6/1999 Dallas et al.
5,946,734 A 9/1999 Vogan
5,950,244 A 9/1999 Fournier et al.
D415,420 S 10/1999 Chen
5,976,451 A 11/1999 Skaja et al.
5,983,405 A 11/1999 Casale
5,992,054 A 11/1999 Rauch
5,996,126 A 12/1999 Berthold et al.
6,029,962 A 2/2000 Shorten et al.
6,051,624 A 4/2000 Bastin et al.
D424,246 S 5/2000 Ho
D426,032 S 5/2000 Walters et al.
6,070,271 A 6/2000 Williams
6,085,878 A 7/2000 Araki et al.
6,093,468 A 7/2000 Toms et al.
6,098,313 A 8/2000 Skaja
6,105,162 A 8/2000 Douglas et al.
6,105,176 A 8/2000 Egger
6,108,825 A 8/2000 Bell et al.
6,154,889 A 12/2000 Moore, III et al.
6,199,942 B1 3/2001 Carroll et al.
6,219,850 B1 4/2001 Halstead et al.
6,226,801 B1 5/2001 Alexander
6,247,745 B1 6/2001 Carroll et al.
D447,604 S 9/2001 Walters et al.
6,298,497 B1 10/2001 Chartrand
6,326,077 B1 12/2001 Monaci
6,351,854 B1 3/2002 Whalen et al.
6,353,953 B1 3/2002 Tanaka et al.
D455,522 S 4/2002 Royes et al.
6,378,140 B1 4/2002 Abraham
6,381,759 B1 5/2002 Katz
6,383,431 B1 5/2002 Dobrin et al.
6,391,935 B1 5/2002 Hager et al.
6,425,141 B1 7/2002 Ewing et al.
6,434,755 B1 9/2002 Glance
6,446,270 B1 9/2002 Durr
6,453,476 B1 9/2002 Moore, III
D464,174 S 10/2002 Lu
6,457,261 B1 10/2002 Crary
6,460,207 B1 10/2002 Papay et al.
6,467,099 B2 10/2002 Dennis et al.
6,485,446 B1 11/2002 Brother et al.
6,499,147 B2 12/2002 Schiebl et al.
6,532,602 B2 3/2003 Watters et al.
6,533,258 B2 3/2003 Monson et al.
6,536,052 B2 3/2003 Tao et al.
6,550,850 B2 4/2003 Laborie et al.
D475,486 S 6/2003 Ide et al.
6,604,246 B1 8/2003 Obreja
D481,171 S 10/2003 Ho
6,634,045 B1 10/2003 DuDonis et al.
6,658,671 B1 12/2003 Von Hoist et al.
6,671,889 B2 1/2004 Dennis et al.
6,679,544 B1 1/2004 Hubbert et al.
6,679,967 B1 1/2004 Carroll, III et al.
6,681,409 B2 1/2004 Dennis et al.
6,682,128 B2 1/2004 Carroll, III et al.
D491,695 S 6/2004 Long
6,752,450 B2 6/2004 Carroll, III et al.
D492,818 S 7/2004 Ide et al.
D495,096 S 8/2004 Long
6,803,005 B2 10/2004 Dennis et al.
6,926,947 B1 8/2005 Seckel
6,994,333 B2 2/2006 Lobry et al.
D521,191 S 5/2006 Jan Gisle Berger
D523,180 S 6/2006 Frye
7,078,443 B2 7/2006 Milliren et al.
D535,059 S 1/2007 Lam
7,178,175 B2 2/2007 Rogers et al.
D541,480 S 4/2007 Turner
7,228,648 B2 6/2007 Yang
7,240,376 B2 7/2007 Ide et al.
7,255,910 B1 8/2007 Seckel
7,299,505 B2 11/2007 Dennis et al.
7,316,036 B2 1/2008 Rudolf et al.
7,338,038 B2 3/2008 Maurer et al.
7,341,776 B1 3/2008 Milliren et al.
7,360,822 B2 4/2008 Carroll, III et al.
D570,055 S 5/2008 Ferrara et al.
7,377,577 B2 5/2008 Carroll, III et al.
7,384,095 B2 6/2008 Cormier
D572,865 S 7/2008 Baker
7,404,593 B2 7/2008 Cormier
D577,866 S 9/2008 Frye et al.
D581,599 S 11/2008 Ferrara et al.
D582,607 S 12/2008 Ferrara et al.
7,458,172 B2 12/2008 Aveni
7,464,414 B2 12/2008 McDuff
D584,456 S 1/2009 Ferrara
7,513,344 B2 4/2009 Toccalino
7,574,760 B2 8/2009 Foley et al.
D603,103 S 10/2009 Ferrara et al.
7,600,268 B2 10/2009 Rogers et al.
7,603,725 B2 10/2009 Harris
7,625,023 B2 12/2009 Audi et al.
D608,688 S 1/2010 Dalzell et al.
7,673,351 B2 3/2010 Copeland et al.
7,676,854 B2 3/2010 Berger et al.
7,677,538 B2 3/2010 Darnell et al.
D617,503 S 6/2010 Szalkowski
7,730,635 B2 6/2010 Aveni et al.
D621,099 S 8/2010 Johnson et al.
D622,449 S 8/2010 Culley et al.
7,770,239 B1 8/2010 Goldman
7,774,866 B2 8/2010 Ferrara
7,802,320 B2 9/2010 Morgan
7,827,617 B2 11/2010 Trainor et al.
7,857,610 B2 12/2010 Rossi et al.
7,866,248 B2 1/2011 Moore et al.

(56) References Cited

U.S. PATENT DOCUMENTS 7,895,681 B2 3/2011 Ferrara
D637,356 S 5/2011 Green et al.
7,950,073 B2 5/2011 Ferrara
D640,422 S 6/2011 Green et al.
7,959,023 B2 6/2011 Ferrara
7,960,473 B2 6/2011 Kobayashi et al.
D645,210 S 9/2011 Chilson et al.
8,039,078 B2 10/2011 Moore et al.
8,047,602 B2 11/2011 Sielhorst et al.
8,056,972 B2 11/2011 Marsden
D650,132 S 12/2011 Chilson et al.
8,069,498 B2 12/2011 Maddux et al.
8,087,187 B2 1/2012 Aveni et al.
8,104,593 B2 1/2012 Lin
D654,628 S 2/2012 Aris et al.
D655,048 S 2/2012 Moeller et al.
D655,051 S 2/2012 O'Keefe et al.
8,201,269 B2 6/2012 Maddux
8,205,272 B2 6/2012 Green
D663,076 S 7/2012 Parsons et al.
8,220,072 B2 7/2012 Dodd
D665,663 S 8/2012 Krupa
D666,779 S 9/2012 Harris
8,298,648 B2 10/2012 Turner
8,348,031 B2 1/2013 Smaldone et al.
8,353,066 B2 1/2013 Rogers et al.
D677,006 S 2/2013 Pfanner et al.
D679,058 S 3/2013 Szalkowski
8,387,164 B2 3/2013 Maddux et al.
8,399,085 B2 3/2013 Moore et al.
D683,905 S 6/2013 Wills
D691,329 S 10/2013 Anderson
8,544,117 B2 10/2013 Erb
8,561,214 B2 10/2013 Turner
8,590,869 B2 11/2013 Tavares et al.
8,702,865 B2 4/2014 Turner
8,713,719 B2 5/2014 Turner
8,726,424 B2 5/2014 Thomas
8,863,320 B2 10/2014 Kelly
8,950,735 B2 2/2015 Reynolds
8,959,723 B2 * 2/2015 Gennrich ..... A42B 3/145 2/410
9,066,551 B2 * 6/2015 Van Waes ..... A42B 3/145
9,131,744 B2 9/2015 Erb
9,320,311 B2 4/2016 Szalkowski
2002/0017805 A1 2/2002 Carroll, III et al.
2002/0023290 A1 2/2002 Walters et al.
2002/0120978 A1 9/2002 Moore
2002/0152542 A1 10/2002 Dennis et al.
2002/0163114 A1 11/2002 Lobry
2002/0168496 A1 11/2002 Morimoto et al.
2003/0106138 A1 * 6/2003 Guay ..... A42B 3/145 2/418
2003/0200677 A1 10/2003 Abraham
2003/0217483 A1 11/2003 Abraham
2003/0230866 A1 12/2003 Lee
2004/0117897 A1 6/2004 Udelhofen
2004/0128860 A1 7/2004 Smaldone
2004/0139531 A1 7/2004 Moore et al.
2004/0154191 A1 8/2004 Park
2004/0188898 A1 9/2004 Siefermann et al.
2004/0199981 A1 10/2004 Tucker
2004/0200094 A1 10/2004 Baychar
2005/0050617 A1 3/2005 Moore et al.
2005/0060793 A1 3/2005 Rosie
2005/0166302 A1 8/2005 Dennis
2005/0196592 A1 9/2005 Tao et al.
2005/0210567 A1 9/2005 Rogers et al.
2005/0217006 A1 10/2005 Sutter et al.
2005/0268383 A1 12/2005 Harris
2006/0059605 A1 3/2006 Ferrara
2006/0059606 A1 3/2006 Ferrara
2006/0064900 A1 3/2006 Aveni
2006/0070170 A1 4/2006 Copeland et al.
2006/0101559 A1 5/2006 Moore et al.
2006/0177635 A1 8/2006 Pepe et al.
2006/0195974 A1 9/2006 Burkhart et al.
2007/0000032 A1 1/2007 Morgan
2007/0083965 A1 4/2007 Darnell et al.
2007/0089219 A1 4/2007 Trainor et al.
2007/0190292 A1 8/2007 Ferrara
2007/0190293 A1 8/2007 Ferrara
2007/0281125 A1 12/2007 Moore, III et al.
2008/0035442 A1 2/2008 Spingler
2008/0036242 A1 2/2008 Glance et al.
2008/0155735 A1 7/2008 Ferrara
2008/0166524 A1 7/2008 Skaja et al.
2008/0236378 A1 10/2008 Sane et al.
2008/0256686 A1 10/2008 Ferrara
2008/0307568 A1 12/2008 Sajic
2009/0038955 A1 2/2009 Ferrara
2009/0049586 A1 2/2009 Wirthenstaetter
2009/0106882 A1 4/2009 Nimmons et al.
2009/0114083 A1 5/2009 Moore et al.
2009/0178184 A1 7/2009 Brine, III et al.
2009/0179361 A1 7/2009 Vito et al.
2009/0210998 A1 8/2009 Rolla
2009/0222975 A1 9/2009 Green et al.
2009/0265841 A1 10/2009 Ferrara
2009/0289026 A1 11/2009 Ferrara
2010/0000009 A1 1/2010 Morgan
2010/0037482 A1 2/2010 Litchfield et al.
2010/0129573 A1 5/2010 Kim
2010/0186150 A1 7/2010 Ferrara et al.
2010/0258988 A1 10/2010 Darnell et al.
2010/0264571 A1 10/2010 Tarazona De La Asuncion et al.
2010/0273944 A1 10/2010 Kobayashi et al.
2010/0295221 A1 11/2010 Kligerman et al.
2010/0295270 A1 11/2010 Marsden
2010/0299812 A1 12/2010 Maddux et al.
2010/0299813 A1 12/2010 Morgan
2011/0004971 A1 1/2011 Benderradji
2011/0047678 A1 3/2011 Barth et al.
2011/0047685 A1 3/2011 Ferrara
2011/0061154 A1 3/2011 Turner
2011/0074075 A1 3/2011 Henry et al.
2011/0094018 A1 * 4/2011 Rogers ..... A42B 3/08 2/421
2011/0107503 A1 5/2011 Morgan
2011/0112448 A1 * 5/2011 Wu ..... A42B 3/145 601/85
2011/0131695 A1 6/2011 Maddux et al.
2011/0167542 A1 7/2011 Bayne et al.
2011/0198788 A1 8/2011 Hines
2011/0296594 A1 8/2011 Thomas et al.
2011/0247744 A1 10/2011 Turner
2011/0277222 A1 * 11/2011 Garneau ..... A42B 3/085 2/421
2012/0017358 A1 1/2012 Princip et al.
2012/0036620 A1 2/2012 Harris
2012/0060251 A1 3/2012 Schimpf
2012/0079646 A1 4/2012 Belanger
2012/0174293 A1 7/2012 Milliren et al.
2013/0152287 A1 6/2013 Cormier et al.
2013/0153350 A1 6/2013 Ferrara
2013/0239303 A1 9/2013 Cotterman
2014/0096310 A1 4/2014 Szalkowski et al.
2014/0325745 A1 11/2014 Erb

FOREIGN PATENT DOCUMENTS

CA 2681439 11/2008
CA 2696242 2/2009
CN 101227842 7/2008
CN 101627222 1/2010
CN 101707885 5/2010
CN 101720999 6/2010
CN 101873811 10/2010
DE 4326049 A1 2/1995
EP 0832572 A1 4/1998
EP 0926960 A1 7/1999
EP 1685019 8/2006
EP 1848293 10/2007
EP 1927294 6/2008

(56) References Cited

FOREIGN PATENT DOCUMENTS

| | | | |
|---|---|---|---|
| EP | 1937466 | | 7/2008 |
| EP | 1848293 | | 7/2009 |
| EP | 2092210 | | 8/2009 |
| EP | 2132516 | | 12/2009 |
| EP | 2146177 | | 1/2010 |
| EP | 2180802 | | 5/2010 |
| ES | 2330138 | | 12/2009 |
| FR | 2717659 | | 9/1995 |
| GB | 1060567 | * | 8/1967 |
| HK | 1112163 | | 11/2009 |
| JP | 54-148845 | | 11/1979 |
| JP | 2006188771 | A1 * | 9/2010 |
| SU | 659134 | | 4/1979 |
| WO | 91/05489 | | 5/1991 |
| WO | 2006/005189 | | 1/2006 |
| WO | 2006022679 | | 3/2006 |
| WO | 2006/088500 | | 8/2006 |
| WO | 2006/089098 | | 8/2006 |
| WO | 2006/089235 | | 8/2006 |
| WO | 2007/035800 | | 3/2007 |
| WO | 2008011708 | | 1/2008 |
| WO | 2008/105840 | | 9/2008 |
| WO | 2008/140650 | | 11/2008 |
| WO | 2009/020583 | | 2/2009 |
| WO | 2009/134334 | | 11/2009 |
| WO | 2010/087957 | | 8/2010 |

OTHER PUBLICATIONS

Patent Translate Powered by EPO and Google, Abstract Translation of JP2006188771,May 2016, Espacenet, p. 1.*
Office Action from U.S. Appl. No. 14/524,675 dated Dec. 8, 2015.
European search report from EP Application No. 13844406 dated Jul. 10, 2015.
Final Office Action from U.S. Appl. No. 14/524,675 dated Apr. 29, 2016.
The Messier Project: The M11 Helmet, 222.cascadeicehockey.com/the-helmet.html (2 pages) Jan. 19, 2010.
The Messier Project: The Technology, www.casecadeicehockey.com/the-technology.html, video slides of the Seven Technology, the video shows 80% compression (2 pages) Jan. 19, 2010.
Schutt Sports: Helmets—HotHead Technology, www.schuttsports.com/aspx/Sport/ProductCatalog.aspx?id-953 (1 page) Jan. 19, 2010.
Technology/SKYDEX, www.skydex.com/technology (3 pages) Jan. 19, 2010.
Blast Limiting/SKYDEX, www.skydex.com/technology/blast_limiting (7 pages) Jan. 19, 2010.
Impact Mitigation/SKYDEX, www.skydex.com/technology/impact_mitigation (7 pages) Jan. 19, 2010.
Manufacturing/SKYDEX, www.skydex.com/technology/manufacturing (2 pages) Jan. 19, 2010.
Development Process/SKYDEX, www.skydex.com/technology/development_process (2 pages) Jan. 19, 2010.
Selection Guide/SKYDEX, www.skydex.com/technology/selection_guide (3 pages) Jan. 19, 2010.
Patent Informaton/SKYDEX, 222.skydex.com/technology/patent (2 pages) Jan. 19, 2010.
Vs. Foam/SKYDEX, www.skydex.com/technology/vs_foam (1 page) Jan. 19, 2010.
Markets & Products/SKYDEX, www.skydex.com/markets_products (3 pages) Jan. 19, 2010.
Military Ballistic Helmet Pads/SKYDEX, www.skydex.com/helmet_pads (6 pages) Jan. 19, 2010.
Body Padding/SKYDEX, www. Wkydex.com/athletic/body_padding (1 page) Jan. 19, 2010.
International Search Report and Written Opinion for International Patent Application No. PCT/US11/38870 dated Oct. 26, 2011.
International Preliminary Report on Patentability for International Patent Application No. PCT/US11/38870 dated Dec. 4, 2012.
International Search Report and Written Opinion for International Patent Application No. PCT/US12/59474 dated Jan. 7, 2013.
Office Action from U.S. Appl. No. 12/792,858 dated Oct. 24, 2012.
International Search Report and Written Opinion for International Patent Application No. PCT/US13/63188 dated Mar. 6, 2014.
Office Action from U.S. Appl. No. 14/524,675 dated Sep. 1, 2016.
Office Action from U.S. Appl. No. 14/254,505 dated Sep. 8, 2016.
Notice of Allowance from U.S. Appl. No. 13/535,767 dated Oct. 21, 2016.
Examination Report from European Patent Application No. 13 844 406.2 dated Jun. 15, 2016.
International Search Report and Written Opinion from International Application No. PCT/US2014/062409 dated Feb. 2, 2015.
Office Action from U.S. Appl. No. 13/535,767 dated Apr. 18, 2016.
Office Action from U.S. Appl. No. 13/535,767 dated Sep. 2, 2015.
International Search Report and Written Opinion from International Application No. PCT/US2012/059474 dated Jan. 7, 2013.
Response to Office Action dated Apr. 29, 2016 from U.S. Appl. No. 14/524,675 dated Jul. 29, 2016.
Examination Report No. 1 from Australian Patent Application No. 2013327099 dated Dec. 2, 2016.
Response to Office Action dated Jun. 15, 2016 from European Patent Application No. 13844406.2 dated Dec. 21, 2016.
Response to Office Action dated Sep. 1, 2016 from U.S. Appl. No. 14/524,675 dated Dec. 1, 2016.
Office Action from U.S. Appl. No. 14/524,675 dated Jan. 27, 2017.

* cited by examiner

HELMET RETENTION SYSTEM

CROSS REFERENCE TO RELATED APPLICATION

This application is a U.S. Non-Provisional Patent Application which claims priority to U.S. Provisional Patent Application No. 61/709,437, filed on Oct. 4, 2012 and titled "Helmet Retention System," which is hereby incorporated by reference in its entirety.

BACKGROUND

Helmets generally include a shell, liner, and retention system. The helmet shell provides protection from protruding objects and is often configured to spread the impact load across the footprint of the helmet. The helmet liner is generally made of a softer and lower density material than the helmet shell. The helmet liner is often configured such that, upon impact, the helmet liner at least partially absorbs the impact energy from the force of an impact. The helmet retention system is generally configured to retain the helmet on the head of the user.

SUMMARY

The present application discloses a helmet, a retention system for a helmet, and a method of adjusting a helmet.

In certain embodiments, the helmet comprises a helmet shell and a retention system attached to the helmet shell. The retention system generally comprises a rear portion connected to the rear of the helmet shell, at least one strap extending from the rear portion to a front portion of the helmet shell, and an adjustment device attached to the rear portion and configured to selectively adjust the length of the strap between the rear portion and the front portion of the helmet shell. The strap generally comprises a strap segment extending from the rear portion and an elongated member attached to the strap segment and movable relative to the helmet shell. The adjustment device is configured to selectively adjust the elongated member to move the strap segment relative to the helmet shell and adjust the length of the strap between the rear portion and the front portion of the helmet shell.

In certain embodiments, the method of adjusting the helmet comprises utilizing a retention system of the present application to stabilize the helmet on a user's head. The retention system generally comprises a rear portion connected to the rear of the helmet shell, at least one strap extending from the rear portion to a front portion of the helmet shell, and an adjustment device attached to the rear portion. The strap generally comprises a strap segment extending from the rear portion and an elongated member attached to the strap segment and movable relative to the helmet shell. The adjustment device is used to selectively adjust the elongated member and move the strap segment relative to the helmet shell to adjust the length of the strap between the rear portion and the front portion of the helmet shell.

DESCRIPTION OF EMBODIMENTS

The present application discloses a helmet, a retention system for a helmet, and a method of adjusting a retention system for a helmet. The retention system generally comprises a rear portion, a plurality of straps, and an adjustment device for adjusting one or more of the straps.

In the embodiments disclosed herein, the retention system is described for use with a military helmet shell. Examples of such military helmet shells include a US Army Advanced Combat Helmet (ACH), a US Marine Corp Lightweight Helmet (LWH), an Enhanced Combat Helmet (ECH), a Personal Armor System for Ground Troops (PASGT) helmet, or other typical ballistic helmet shells. However, the retention system may also be used with a variety of other helmets, including, but not limited to, tactical helmets, aircrew and flight helmets, sporting helmets, such as football, lacrosse, hockey, multi-sport, cycling, whitewater, climbing, softball, or baseball helmets, or safety helmets, such as industrial or construction helmets.

The present application discusses adjustment of the length of straps between two points. Adjustment of the length of a strap between two points means the distance between the two points is adjusted (i.e., increased or decreased). For example, straps between a chin portion and a rear portion of the retention system may be selectively adjusted to increase or decrease the distance between the chin portion and the rear portion. Further, any one or more straps of the present application may comprise one or a plurality of strap segments or other components, such as lacing or wire. For example, a strap between two points may comprise a strap segment and lacing attached to the strap segment. Selective adjustment of the length of the strap, such as, for example, by adjusting the lacing attached to the strap segment, increases or decreases the distance between the two points.

Figure 1:
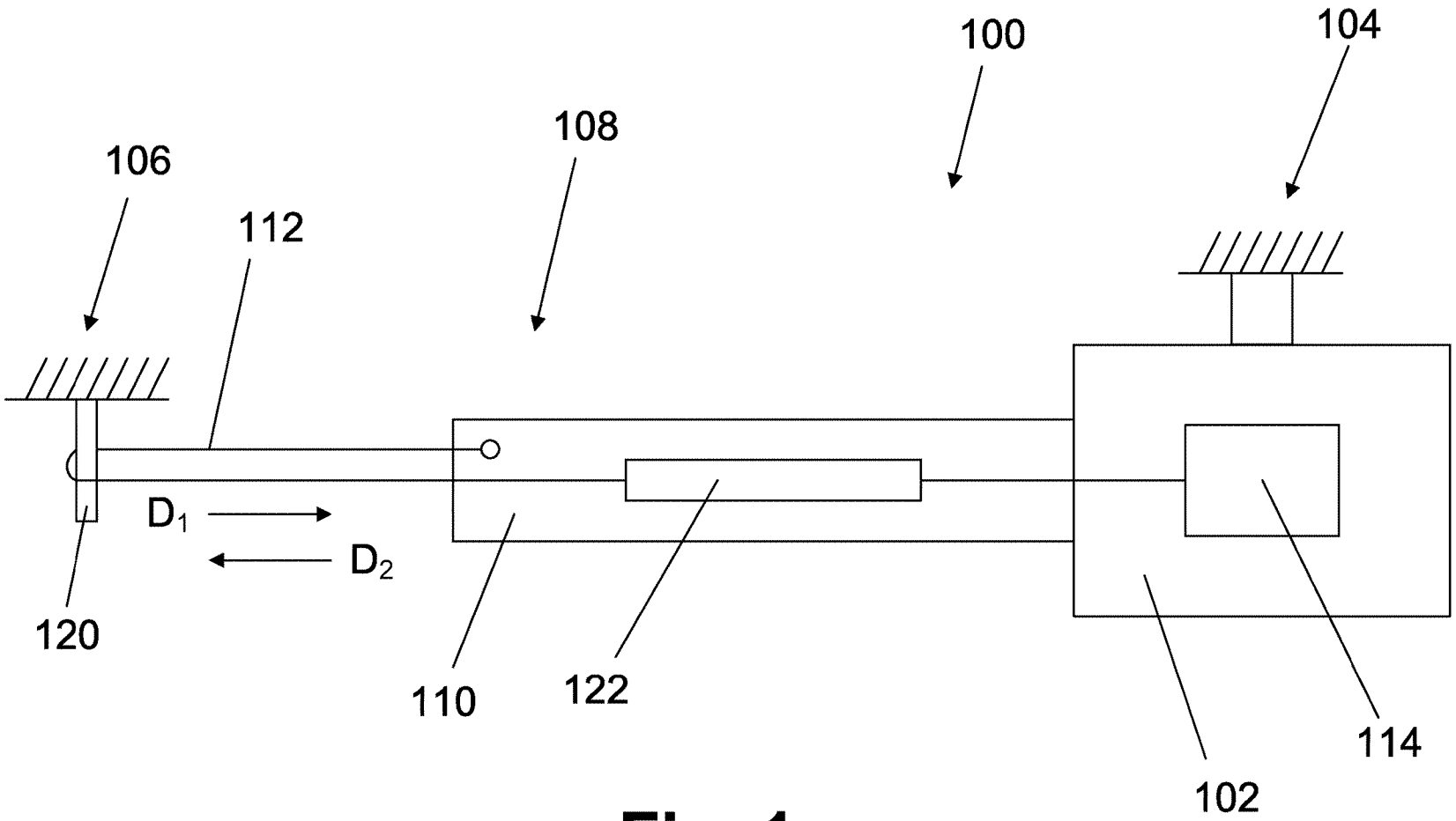
FIG. 1 is a schematic illustrating a helmet retention system according to an embodiment of the present application.

FIG. 1 schematically illustrates a retention system 100 according to an embodiment of the present application. The retention system 100 comprises a rear portion 102 attached to a rear 104 of a helmet shell, at least one flexible strap 108 extending from the rear portion to a front portion 106 of the helmet shell, and an adjustment device 114 attached to the rear portion for adjusting the length of the strap between the rear portion and the front portion of the helmet shell. The adjustment device 114 may be a variety of devices capable of adjusting the length of the strap 108, such as, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap. In certain embodiments, the adjustment device 114 is a lacing device.

As illustrated in FIG. 1, the strap 108 comprises a flexible strap segment 110 and a flexible elongated member 112, such as, e.g., a wire, lace, or belt, attached to the strap segment. The elongated member 112 extends from the strap segment 110, through a securing member 120 of the helmet, through an attachment portion 122 of the strap segment, and to the adjustment device 114. The adjustment device 114 is configured to adjust the elongated member 112 by selectively altering the free length of the member. The attachment portion 122 attaches the elongated member 112 to the strap segment 110 and permits the member to move relative to the strap segment. The attachment portion 122 may be shaped and configured in a variety ways, such as, for example, a tube or conduit, one or more eyelets or arches, a sheath, a sleeve, a pocket, a passage, one or more slots or openings in the strap segment, or the like. The elongated member 112 may comprise a variety of materials, including steel, plastic, or fabric. In one embodiment, the elongated member 112 is made from Aircraft grade stainless steel.

When the adjustment device 114 is manipulated to retract the elongated member 112 into the adjustment device, the elongated member is moved in a first direction $D_1$ through the attachment member 122 and the securing member 120. Further, the strap segment 110 is pulled toward the securing member 120. The securing member 120 may be attached directly or indirectly to the helmet. In certain embodiments, the securing member 120 comprises a strap segment that is configured to be attached to the helmet and a clip that movably attaches the elongated member 112 to the strap segment. However, a variety of other means for movably attaching the elongated member to the helmet may be used. For example, in certain embodiments, an opening in the helmet, an opening in a strap segment, an eyelet, a loop, a ring, a clip, a sheath, a sleeve, a passage, a conduit, a buckle, a fastener, or the like may be used to movably attach the elongated member to the helmet.

In certain embodiments, the securing member 120 is attached at the right and/or left front side or temple portion of the helmet. Thus, when the elongated member 112 is retracted into the adjustment device 114, at least a portion of the strap 108 is tightened against the side of the user's head and the rear portion 102 is pulled in a direction forward and upward against the rear of the user's head. Further, the retention system 100 is generally configured with straps 108 extending from the rear portion 102 on both the right and left sides of the helmet. As such, retraction of the elongated members 112 of the right and left straps 108 will fit the retention system 100 around the circumference of the user's head and stabilize the helmet shell on the user's head.

When the adjustment device 114 is manipulated to release the elongated member 112 and permit the member to be pulled out of the adjustment device, the elongated member is permitted to move in a second direction $D_2$ through the attachment member 122 and the securing member 120. Further, the strap segment 110 is permitted to move away from the securing member 120. As such, the strap 108 and the rear portion 102 of the retention system 100 are loosened to facilitate removal of the helmet shell from the user's head. In certain embodiments, the adjustment device 114 may be used to move the elongated member 112 in the second direction $D_2$ through the attachment member 122 and the securing member 120. Further, the adjustment device 114 may be used to move the strap segment 110 away from the securing member 120.

The rear portion 102 of the retention system 100 is generally configured to contact the rear of the user's head, e.g., the occipital or suboccipital portion of the head, and/or the nape of the user's neck and acts as an anchor point of the system. The rear portion may or may not extend below the rear edge of the helmet shell such that it is exposed and accessible to the user when wearing the helmet. The rear portion 102 may also be a variety of shapes and sizes, e.g., the rear portion may be shaped as a truncated triangle, square, rectangle, circle, or any other shape. The rear portion 102 may comprise padding material (e.g., foam) with a canvas covering. However, in certain embodiments, the rear portion may or may not be padded and may include one or more pieces of fabric or polymer material.

In certain embodiments, the retention system of the present application comprises a chin portion, a rear portion, a plurality of straps, and a lacing device for adjusting one or more of the straps. The chin portion is generally configured to receive the chin of a person wearing the helmet. The rear portion is connected to the chin portion and the rear of the helmet. A pair of first straps extend from the chin portion to the rear portion and the length of each first strap between the chin portion and rear portion is selectively adjustable. A pair of second straps extend from the chin portion to the front of the helmet and the length of each second strap between the chin portion and the front of the helmet is selectively adjustable. A pair of third straps extend from the rear portion to the front of the helmet. Each third strap comprises a strap segment and a lace portion attached to the strap segment. The lacing device is attached to the rear portion and configured to selectively adjust the lace portions relative to the lacing device to adjust a length of each third strap between the rear portion and the front of the helmet.

Figure 2A:
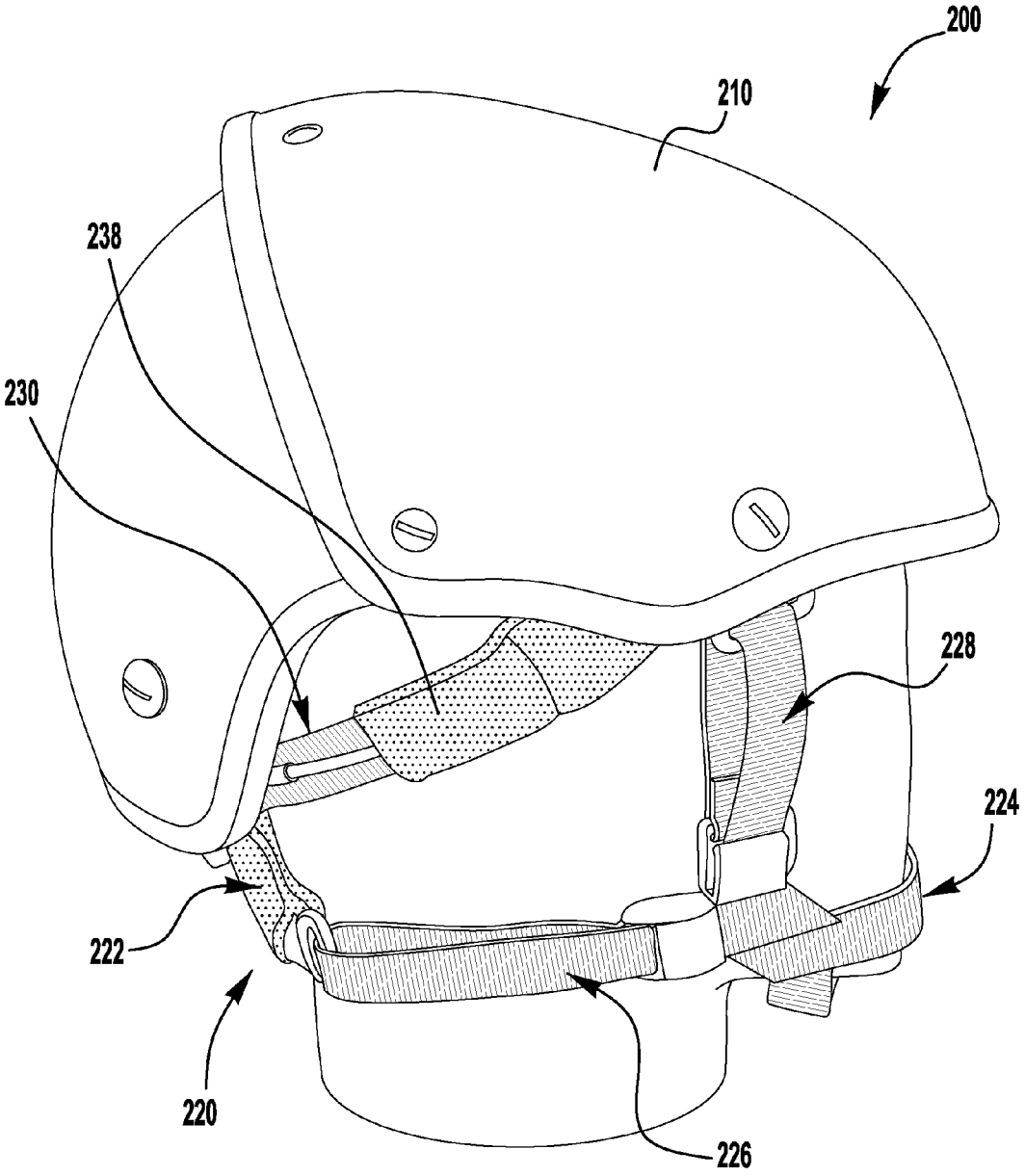
FIG. 2A is a right side view of a helmet having a retention system according to an embodiment of the present application.
Figure 2B:
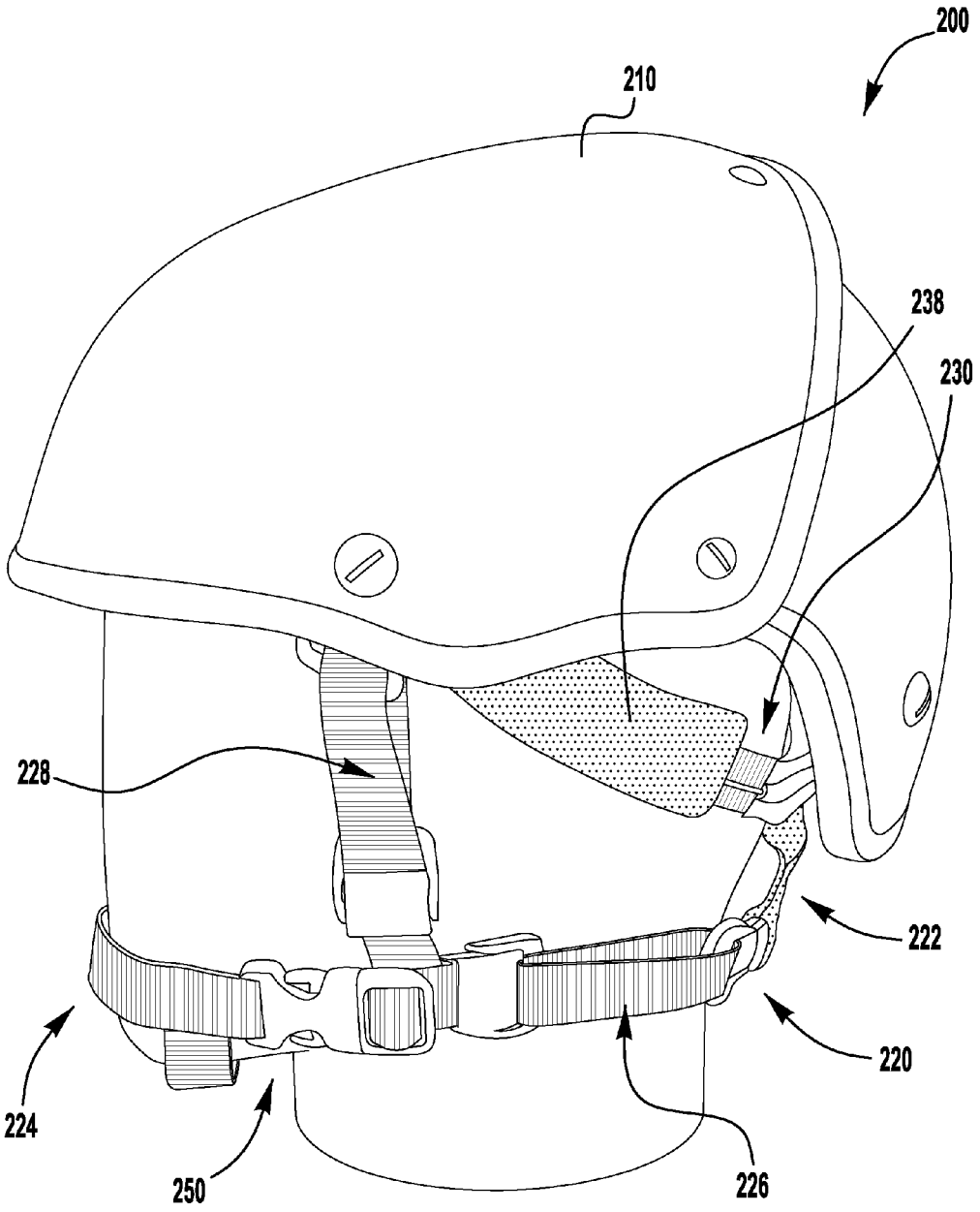
FIG. 2B is a left side view of the helmet of FIG. 2A.
Figure 2C:
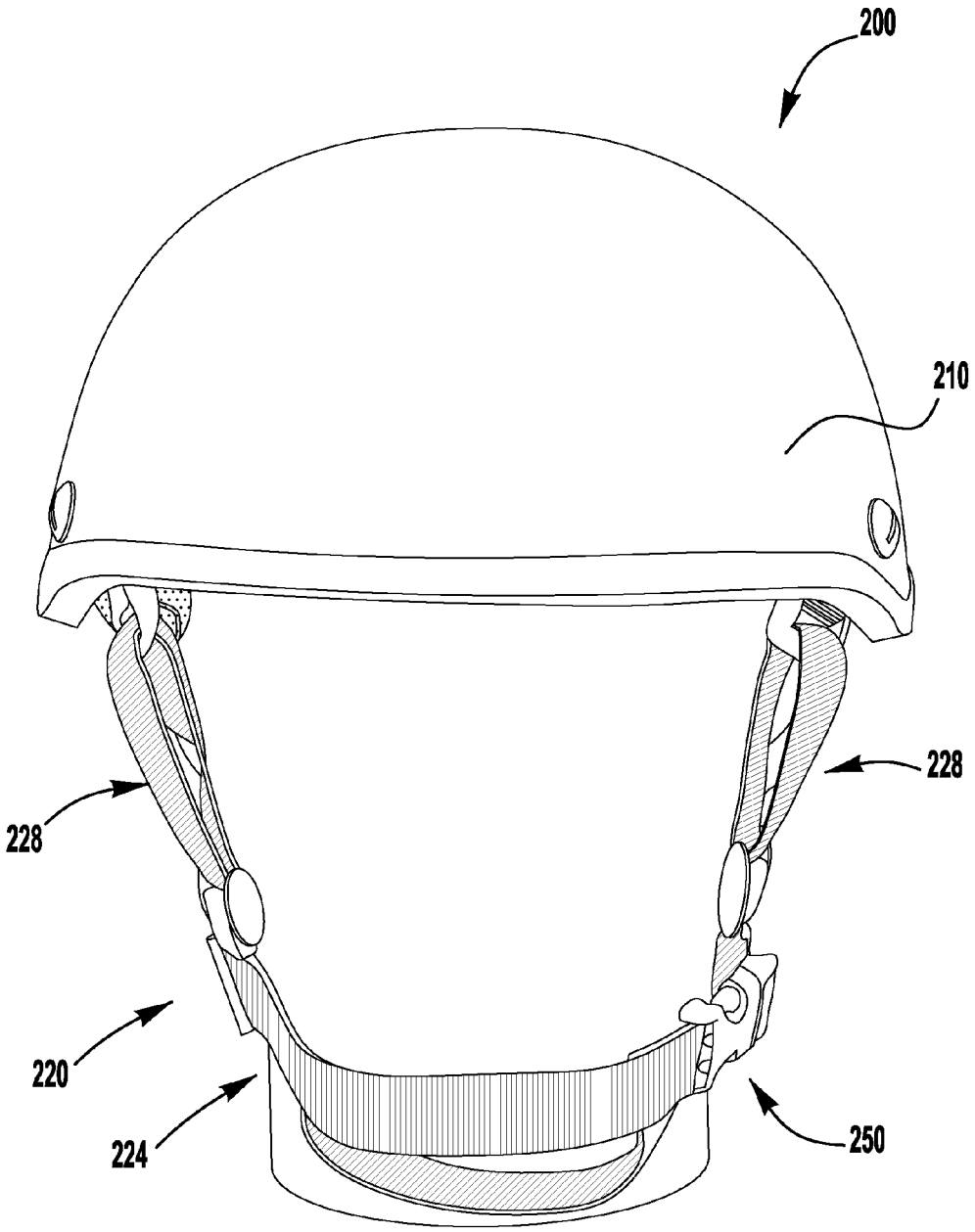
FIG. 2C is a front view of the helmet of FIG. 2A.
Figure 2D:
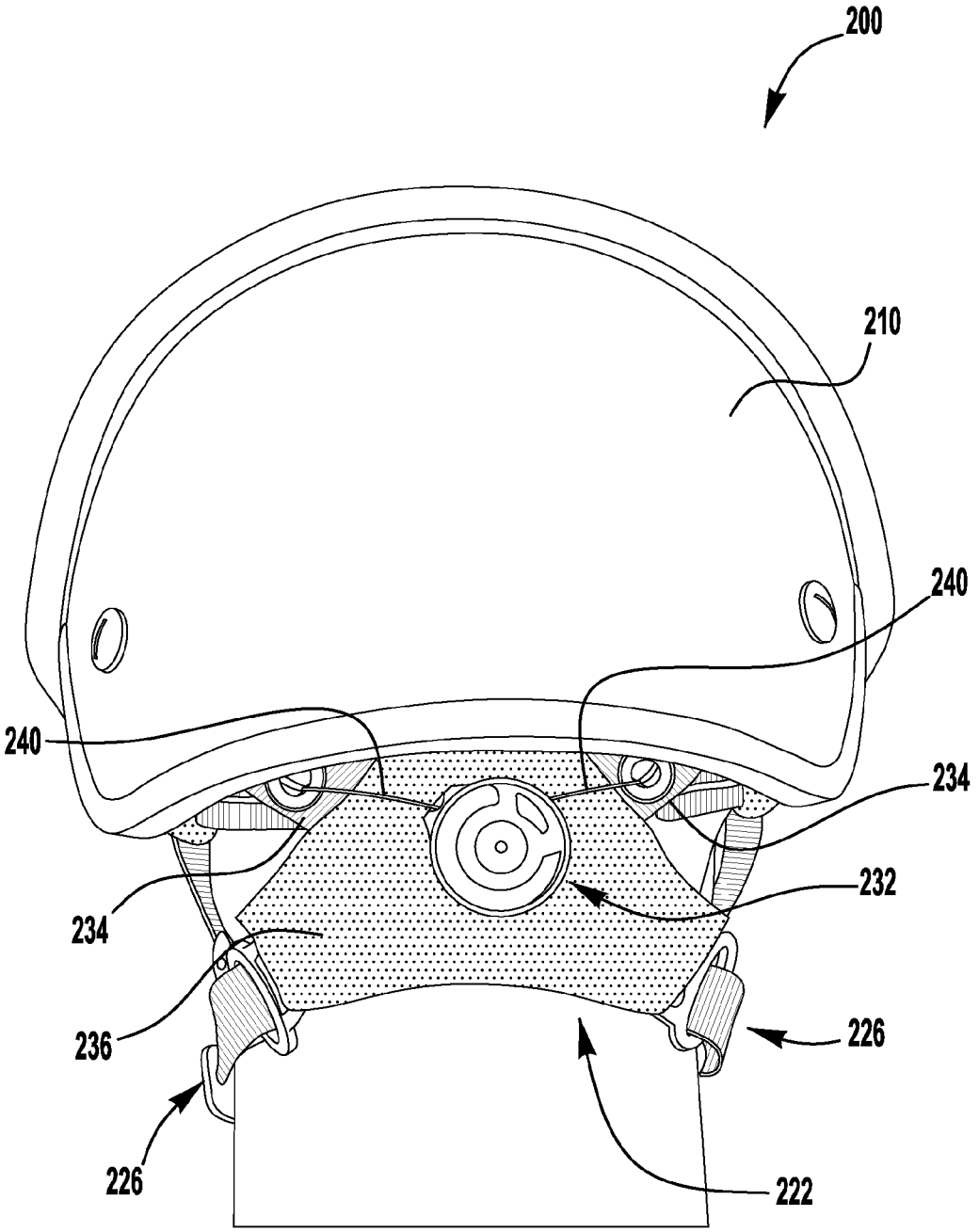
FIG. 2D is a rear view of the helmet of FIG. 2A.

FIGS. 2A-2D illustrate a helmet 200 having a helmet shell 210 and a retention system 220 according to an embodiment of the present application. The retention system 220 is connected to the helmet shell 210 and is configured to hold and stabilize the helmet shell on the user's head. As shown, the retention system 220 comprises a chin portion 224, a rear portion 222, a plurality of straps 226, 228, and 230, and a lacing device 232 (FIG. 2D).

The chin portion 224 of the retention system 220 is configured to receive the chin of the user and acts as a first anchor point of the system. As shown in FIGS. 2A-2C, the chin portion 224 comprises a plurality of flexible straps, or webbing, that are sewn together and are sized and configured to receive the user's chin. However, the chin portion may be configured in a variety of other ways. For example, the chin portion may comprise one or more flexible pieces of fabric or polymer material. Further, the chin portion may comprise a chincup made of one or more components, such as, for example, a polymer or metallic structure formed as a chincup. Further still, the chin portion may comprise a liner material such as ultrasuede or padding material to provide comfort to the user's chin.

The rear portion 222 of the retention system 220 contacts the rear of the user's head, e.g., the occipital or suboccipital portion of the head, and/or the nape of the user's neck and acts as a second anchor point of the system. As shown in FIG. 2D, the rear portion 222 comprises a pad 236 attached to the helmet shell 210 by one or more attachment straps 234 or webbing. At least a portion of the pad 236 extends below the rear edge of the helmet shell 210 such that it is exposed and accessible to the user when wearing the helmet 200. The pad 236 may be a variety of shapes and sizes. As shown in FIG. 2D, the pad 236 is shaped as a truncated triangle with a bottom edge extending substantially the width of the user's neck. The pad 236 comprises a padding material (e.g., foam) with a canvas covering and has a thickness between about 0.1 and 0.5 inches. However, in certain embodiments, the rear portion may or may not be padded and may include one or more pieces of fabric or polymer material.

As illustrated in FIGS. 2A-2D, the retention system 220 comprises a pair of first straps 226, or webbing, connecting the chin portion 224 to the rear portion 222 of the system. The length of each first strap 226 between the chin portion 224 and the rear portion 222 may be selectively adjusted to tighten the rear portion against the user's head and/or neck and the rear of the helmet shell 210 down on the user's head. As illustrated, each first strap 226 comprises a cam lock slider or cam buckle that permits the length of the strap to be selectively adjusted by the user with one hand by pressing down and moving the slider or buckle. However, other strap adjustment devices may be used, such as, for example, various loops, slides, adjusters, clasps, buckles, hook and loop fasteners such as Velcro®, or other strap adjustment devices. Further, in certain embodiments, one or more of the first straps may not be adjustable and/or may be made of an elastic material.

The retention system 220 also comprises a pair of second straps 228, or webbing, connecting the chin portion 224 to the front of the helmet shell 210. As illustrated in FIGS. 2A-2C, the second straps 228 extend from the chin portion 224 to the right and left front sides or temple portions of the helmet shell 210. The length of each second strap 228 between the chin portion 224 and the front of the helmet shell 210 may be selectively adjusted to tighten the front of the helmet shell down on the user's head. As illustrated, each second strap 228 comprises a cam lock slider or cam buckle that permits the length of the strap to be selectively adjusted by the user with one hand. However, other strap adjustment devices may be used, such as, for example, a loop, slide, adjuster, clasp, buckle, hook and loop fasteners such as Velcro®, or other strap adjustment device. Further, in certain embodiments, one or more of the second straps may not be adjustable and/or may be made of an elastic material.

The retention system 220 also comprises a pair of third straps 230, or webbing, connecting the rear portion 222 to the front of the helmet shell 210. As illustrated in FIGS. 2A-2B, the third straps 230 extend from the rear portion 222 to the right and left front sides or temple portions of the helmet shell 210. The length of each third strap 230 between the rear portion 222 and the front of the helmet shell 210 may be selectively adjusted to fit the retention system around the circumference of the user's head and stabilize the helmet shell on the user's head. Various strap adjustment devices may be used, such as, for example, a loop, slide, adjuster, clasp, buckle, hook and loop fasteners such as Velcro®, or other strap adjustment device. Further, in certain embodiments, one or more of the third straps may not be adjustable and/or may be made of an elastic material. As illustrated in FIGS. 2A and 2B, comfort pads 238 at least partially surround a portion of the third straps 230 to provide comfort to the sides of the user's head.

An adjustment device may be used to selectively adjust the length of the third straps 230 between the rear portion 222 and the front of the helmet shell 210. In certain embodiments, the adjustment device is attached to the rear portion 222 and below the rear edge of the helmet shell 210 such that it is exposed and accessible to the user when wearing the helmet. Examples of adjustment devices that may be used include, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap.

As illustrated in FIG. 2D, the adjustment device comprises a wire or lacing device 232 attached to the rear portion 222 below the rear edge of the helmet shell 210. As illustrated, the lacing device 232 is a Boa lacing system, however other adjustable wire, lacing, belt, or strap devices may be used. As described in greater detail below, wires or laces 240 extending from the lacing device 232 are used to selectively adjust the length of the third straps 230 between the rear portion 222 and the front of the helmet shell 210. The wires or laces 240 may comprise a variety of materials, including steel, plastic, or fabric. In one embodiment, the wires or laces 240 are made from Aircraft grade stainless steel.

Figure 3:
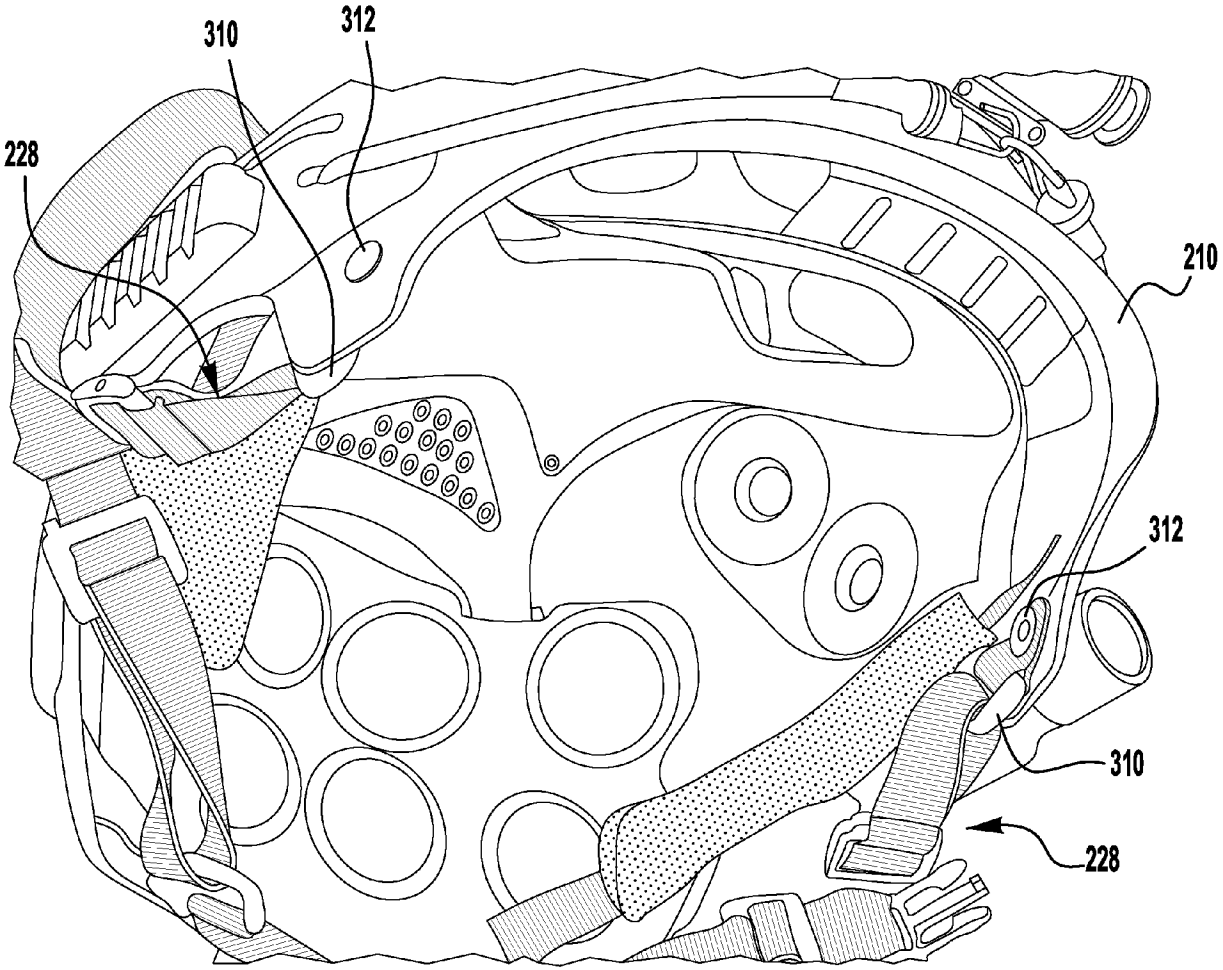
FIG. 3 is a partial bottom perspective view of the inside of a helmet having a retention system according to an embodiment of the present application.

The second, third, and attachment straps 228, 230, and 234 may be attached to the helmet shell 210 in a variety of ways. For example, in certain embodiments, one or more of the straps are attached to a loop or other securing member that is attached to the helmet shell 210 with a fastener, such as a bolt or other fastening device. As an example, FIG. 3 illustrates the second straps 228 attached to a loop 310 that is attached to the helmet shell 210 with a fastener 312. In certain embodiments, a fastener is received through a hole in one or more of the straps to attach the strap directly to the helmet shell. Other methods of attaching the straps to the helmet shell may also be used, such as, for example, by threading the strap through an opening in the helmet shell or by use of an adhesive. Furthermore, any one or more of the second, third, and attachment straps 228, 230, and 234 may be attached to a helmet liner of the helmet shell.

The attachment of any one or more of the second, third, and attachment straps 228, 230, and 234 to the helmet shell 210 may also be adjustable. For example, the loop or other securing member attaching the strap to the helmet shell may be configured such that the distance from the strap attachment point to the helmet attachment point is adjustable. For example, a piece of strap, or webbing, attaching the loop or other securing member to the helmet shell may comprise a plurality of holes that may be used to attach the loop or securing member to the helmet shell. Furthermore, any one or more of the second, third, and attachment straps 228, 230, and 234 may comprise a plurality of holes that may be used to attach the strap directly to the helmet shell.

As illustrated in FIGS. 2B and 2C, the retention system 220 comprises a buckle 250 to permit removal of the retention system and the helmet shell 210 from the head of the user. As illustrated, a first portion of the buckle 250 is attached to the chin portion 224 of the retention system 220 and a second portion of the buckle is attached to the first and second straps 226 and 228 of the retention system. As such, release of the buckle 250 permits the chin portion 224 to be disconnected from the first and second straps 226 and 228 such that the user can remove the helmet 200.

Figure 4A:
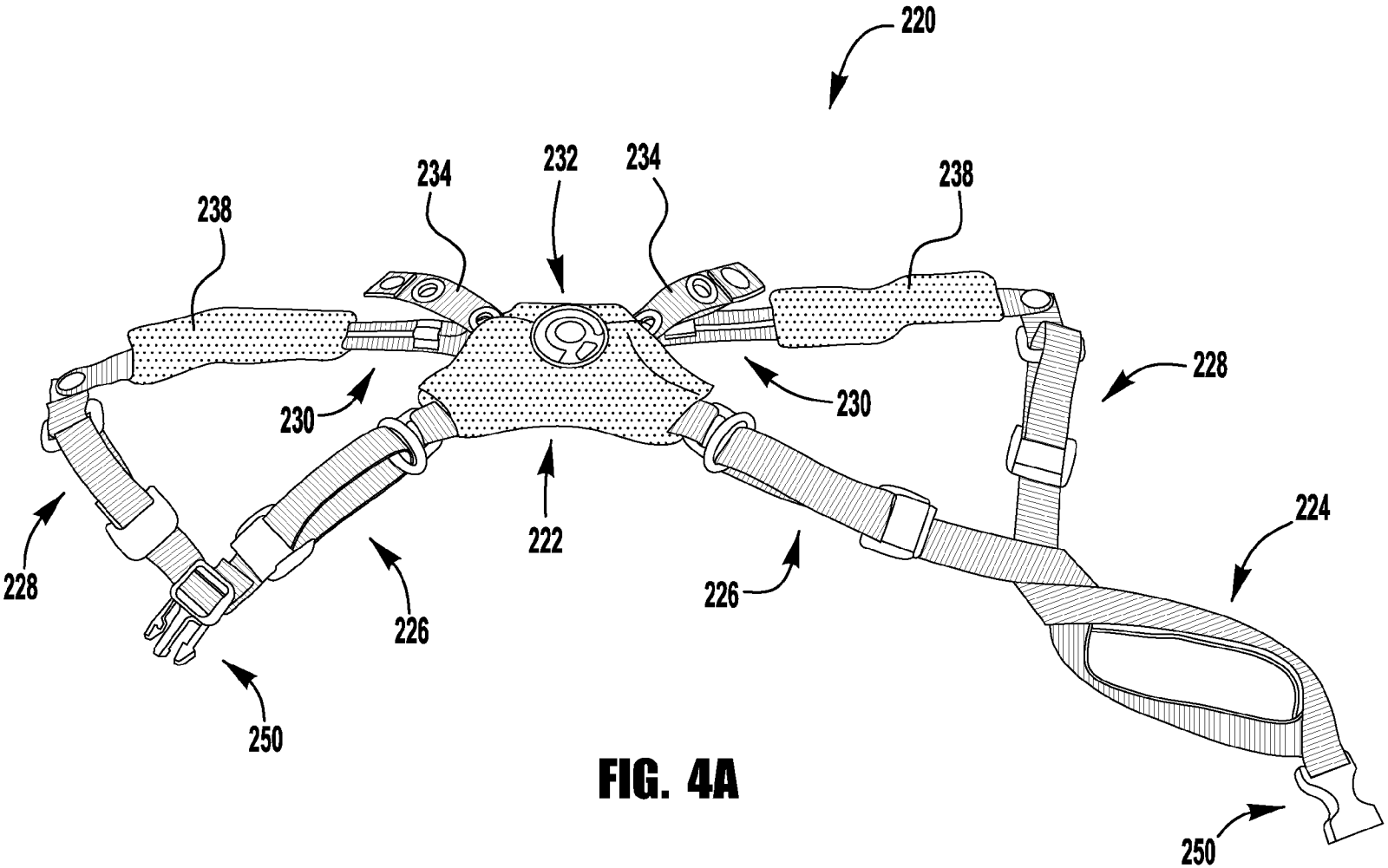
FIG. 4A is a top plan view of the retention system of FIG. 2A removed from the helmet.
Figure 4B:
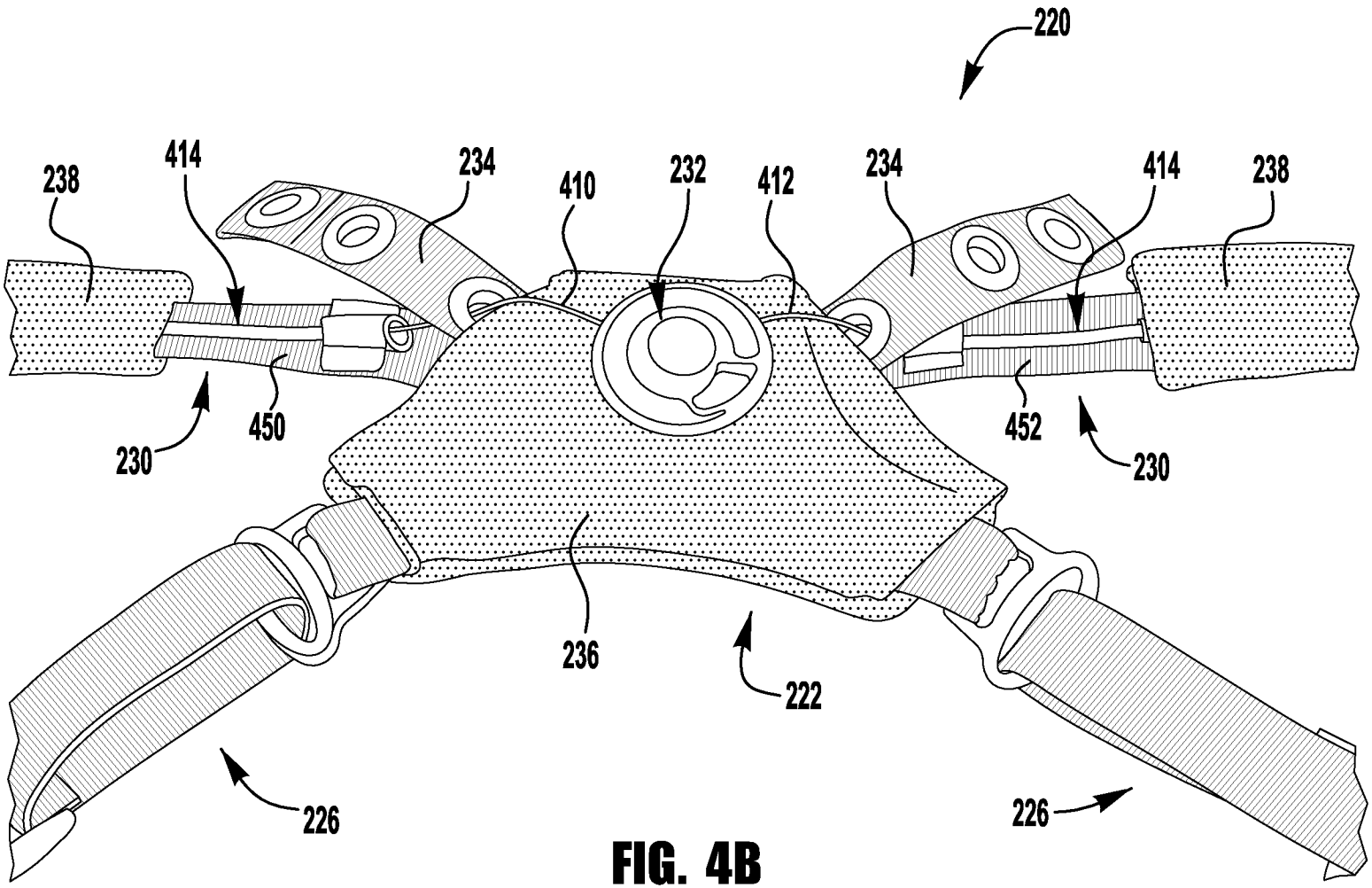
FIG. 4B is a partial top plan view of the retention system of FIG. 4A.
Figure 4C:
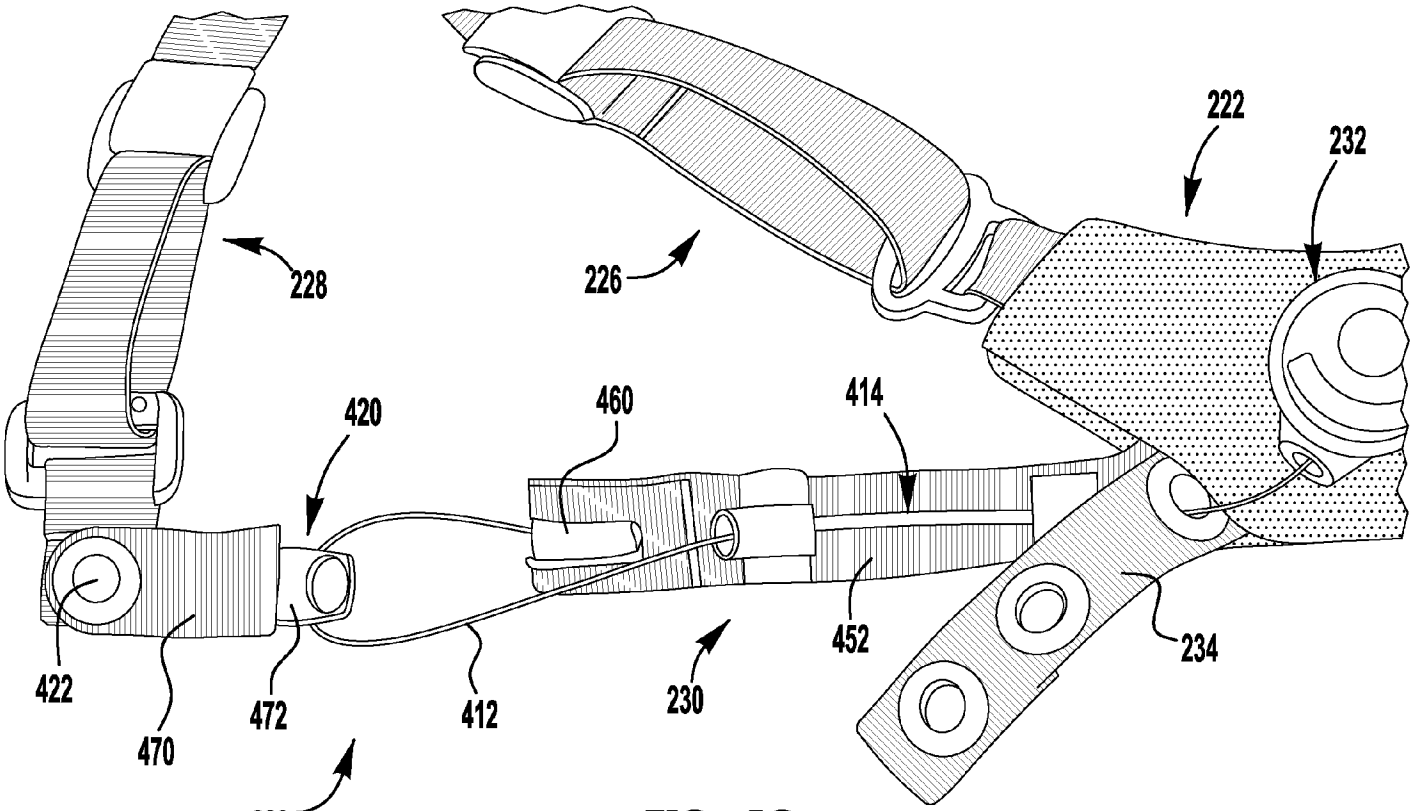
FIG. 4C is a partial top plan view of the retention system of FIG. 4A.

FIGS. 4A-4C illustrate the retention system 220 removed from the helmet shell 210. FIGS. 4A and 4B illustrate the retention system 220 with the comfort pads 238 and FIG. 4C illustrates the retention system with the comfort pads removed.

As illustrated in FIGS. 4A and 4B, first and second lace portions 410 and 412 extend from the lacing device 232 and through openings in the attachment straps 234 of the rear portion 222. The first and second lace portions 410 and 412 are routed through tubes 414 attached to the outer surface of strap segments 450 and 452 of the third straps 230. The tubes 414 movably attach the lace portions 410 and 412 to the strap segments 450 and 452 to permit selective adjustment of the length of each third strap 230 between the rear portion 222 and the front of the helmet shell. However, other means for movably attaching the lace portions to the strap segments may be used. For example, in certain embodiments, one or more eyelets or arches, a sheath, a sleeve, a pocket, a passage or conduit, one or more slots or openings in the strap segment, or the like may be used to movably attach the lace portions to the strap segments.

FIG. 4C illustrates one side of the retention system 220 with the comfort pad removed to better show the connection of the lace portion. Although only one side of the retention system 220 is shown in FIG. 4C, the connection of the lace portion is the same for both sides of the retention system. As, each third strap 230 comprises the strap segment 450 or 452 and the lace portion 410 or 412 attached to the strap segment.

As illustrated in FIG. 4C, the lace portion 412 exits the tube 414 and is routed through a securing member 420 that is configured to be attached to the helmet shell, such as with a fastener inserted through opening 422. The securing member 420 movably attaches the lace portion 412 to the helmet shell to permit selective adjustment of the length of each third strap 230 between the rear portion 222 and the front of the helmet shell. The end of the lace portion 412 is then attached to the strap segment 452 of the third strap 230.

As illustrated in FIG. 4C, the securing member 420 comprises a strap segment 470 that is configured to be attached to the helmet shell and a clip 472 that movably attaches the lace portion 412 to the helmet shell. However, other means for movably attaching the lace portion to the helmet shell may be used. For example, in certain embodiments, an opening in the helmet shell, an opening in a strap segment, an eyelet, a loop, a ring, a clip, a sheath, a sleeve, a passage, a conduit, a buckle, a fastener, or the like may be used to movably attach the lace portion to the helmet shell.

As illustrated in FIG. 4C, the end of the lace portion 412 comprises an enlarged portion 460 that is attached to the strap segment 452 by folding an end of the strap segment over and attaching it to itself to hold the enlarged portion in place. However, a variety of other methods may be used to attach the end of the lace portion 412 to the strap segment 452, such as, for example, by routing the lace portion through an opening in the strap segment or using an adhesive, a loop or other fastening device to secure the lace portion to the strap segment. As illustrated in FIGS. 4A and 4B, the comfort pads 438 are configured to at least partially surround the connection and exposed lace portions 410 and 412 to protect the lace portions and provide comfort to the side of the user's head.

The lacing device 232 may be manipulated to retract the first and second lace portions 410 and 412 into the lacing device (e.g., by rotating a dial of the lacing device). When this occurs, each lace portion 410 and 412 is moved in a first direction through the tube 414 and securing member 420 and the end of the strap segment 450 and 452 is pulled toward the securing member. As illustrated in FIGS. 2A-2C, the securing members are attached at the right and left front sides or temple portions of the helmet shell 210. As such, when the lace portions 410 and 412 are retracted into the lacing device 232, at least portions of the third straps 230 are tightened against the sides of the user's head and the rear portion 222 is pulled in a direction forward and upward against the rear of the user's head to fit the retention system 220 around the circumference of the user's head and stabilize the helmet shell 210 on the user's head.

The lacing device 232 may also be manipulated to release the first and second lace portions 410 and 412 and permit the lace portions to be pulled out of the lacing device (e.g., by pulling up on a dial of the lacing device). When this occurs, each lace portion 410 and 412 is permitted to move in a second direction through the tube 414 and securing member 420 and the strap segment 450 and 452 is permitted to move away from the securing member. As such, the third straps 230 and the rear portion 222 of the retention system 220 are loosened to facilitate removal of the helmet shell 210 from the user's head. In certain embodiments, the lacing device 232 may be used to move the lace portions 410 and 412 in the second direction through the tube 414 and the securing member 420. Further, the lacing device 232 may be used to move the strap segments 450 and 452 away from the securing members 420.

Figure 5:
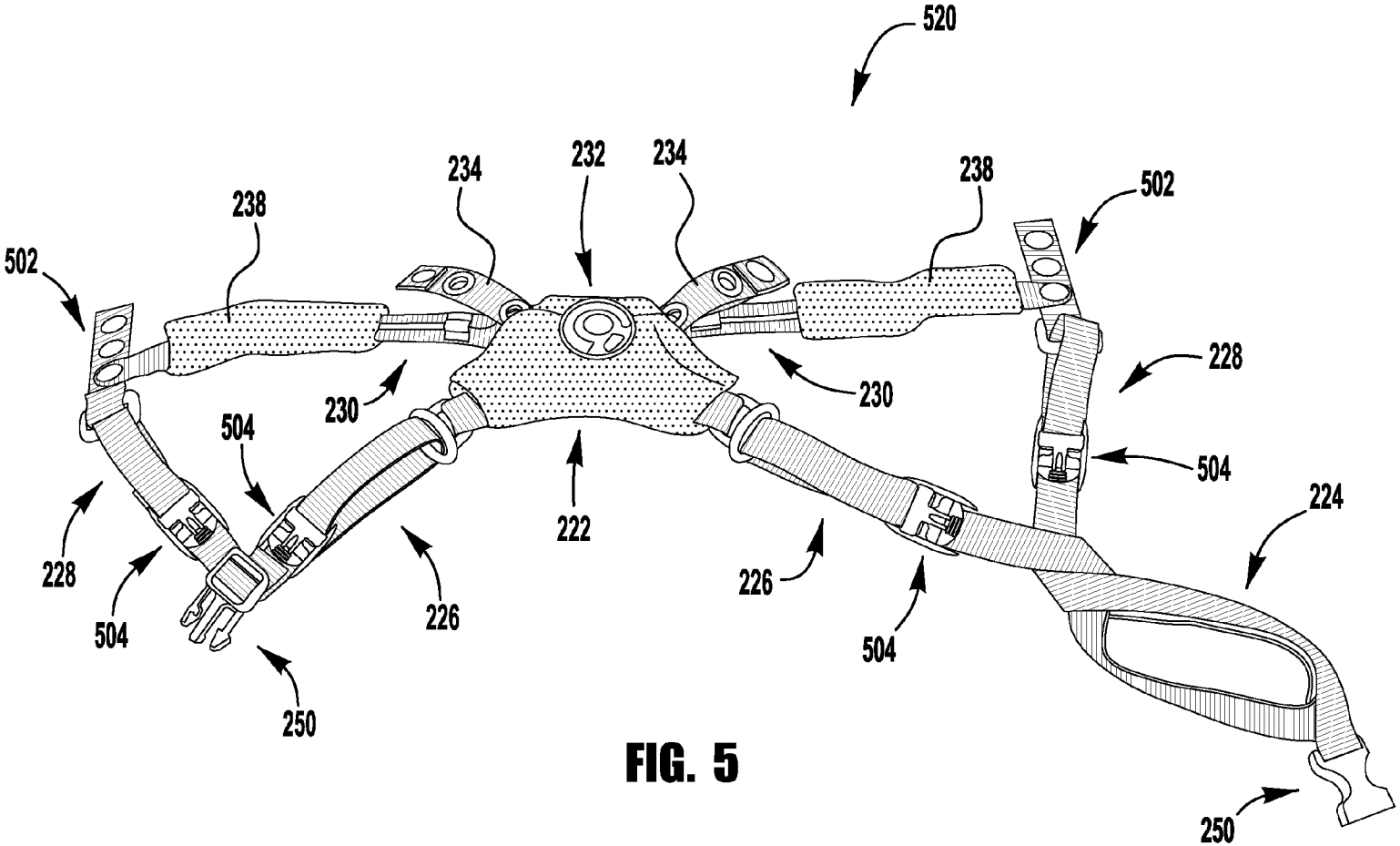
FIG. 5 is a top plan view of a retention system removed from a helmet and according to an embodiment of the present application.

FIG. 5 illustrates a retention system 520 removed from the helmet shell. The retention system 520 is similar to the retention system 220 and, when connected to the helmet shell, is configured to hold and stabilize the helmet shell on the user's head. Similar to retention system 220, the retention system 520 comprises a chin portion 224, a rear portion 222, a plurality of straps 226, 228, and 230, and a lacing device 232. Each first and second strap 226 and 228 of the retention system 520 comprises a cam lock slider or cam buckle 504 that permits the length of the strap to be selectively adjusted by the user with one hand by flipping the top open and moving the slider or buckle. Further, the attachment point of each second and third strap 228 and 230 to the helmet shell is adjustable. As illustrated, an end portion 502 of each second strap 228 comprises a plurality of holes that may be used to attach the second and third straps to the helmet shell.

An exemplary method of adjusting the fit of a helmet on a user's head is described below. A retention system of the present application is attached to a helmet shell to stabilize the helmet on the user's head. In certain embodiments, the retention system comprises a rear portion connected to the rear of the helmet shell, at least one strap extending from the rear portion to a front portion of the helmet shell, and an adjustment device attached to the rear portion. The strap comprises a strap segment extending from the rear portion and an elongated member attached to the strap segment and movable relative to the helmet shell. The adjustment device is used to selectively adjust the elongated member and move the strap segment relative to the helmet shell to adjust the length of the strap between the rear portion and the front portion of the helmet shell.

When the adjustment device is used to move the strap segment in a first or forward direction toward the front portion of the helmet, the strap is tightened against the side of the user's head and the rear portion is pulled in a direction forward and upward against the rear of the user's head to fit the retention system on the user's head and stabilize the helmet shell on the user's head. Further, when the adjustment device is used to move or permit movement of the strap segment in a second or rearward direction away from the front portion of the helmet, the strap and the rear portion are loosened to facilitate removal of the helmet shell from the user's head.

In certain embodiments, the retention system comprises a securing member attached to the front portion of the helmet shell that movably attaches the elongated member to the helmet shell. The adjustment device is used to move the elongated member through the securing member and the strap segment toward the securing member to decrease the length of the strap between the rear portion and the front portion of the helmet shell. Further, the adjustment device is used to permit movement of the elongated member through the securing member and the strap segment away from the securing member to increase the length of the strap between the rear portion and the front portion of the helmet shell.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, component geometries, shapes, and dimensions can be modified without changing the overall role or function of the components. Therefore, the inventive concept, in its broader aspects, is not limited to the specific details, the representative device, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A helmet, comprising:

a helmet shell; and a retention system attached to the helmet shell, the retention system comprising:

a rear portion connected to a rear of the helmet shell;

left and right first side straps extending from the rear portion of the retention system to left and right front portions of the helmet shell, respectively;

left and right securing members attached to the left and right front portions of the helmet shell, respectively, for securing the left and right first side straps to the helmet shell;

an adjustment device attached to the rear portion of the retention system and configured to selectively adjust a first side strap length of the left and right first side straps between the rear portion of the retention system and the left and right securing members;

a chin portion configured to receive a chin of a user;

left and right second side straps extending from the chin portion to the rear portion of the retention system, wherein a second side strap length of each of the left and right second side straps between the chin portion and the rear portion is selectively adjustable; and left and right third side straps extending from the chin portion to the left and right front portions of the helmet shell, respectively, wherein a third side strap length of each of the left and right third side straps between the chin portion and the left and right front portions is selectively adjustable; and wherein the left and right first side straps comprise:

a strap segment extending from the rear portion of the retention system; and an elongated member movably attached to the strap segment via an attachment portion and extending from the adjustment device to the respective securing member, wherein the adjustment device is configured to selectively adjust a length of the elongated member to move the strap segment relative to the helmet shell and along the elongated member, and to adjust the first side strap length of the respective first side strap between the rear portion of the retention system and the respective front portion of the helmet shell by changing a distance between the strap segment and the respective securing member; and wherein at least a portion of the left and right first side straps are configured to be tightened against a left side and a right side, respectively, of a head of the user, and the rear portion of the retention system is configured to be pulled forward and upward against a rear portion of the head of the user when the respective elongated member is retracted into the adjustment device.

2. The helmet of claim 1, wherein the left and right securing members comprise a securing strap segment attached to the helmet shell and a clip that movably attaches each of the elongated members to the respective securing strap segment.

3. The helmet of claim 1, wherein each attachment portion comprises a tube attached to the respective strap segment.

4. The helmet of claim 1, wherein each elongated member is moved through the respective securing member and the respective attachment portion, and the respective strap segment is moved toward the respective securing member when the respective elongated member is retracted into the adjustment device.

5. The helmet of claim 1, wherein the adjustment device is a lacing device and each elongated member is a lace.

6. The helmet of claim 1, wherein the rear portion of the retention system comprises a padding material and a covering.

7. The helmet of claim 6, wherein the rear portion of the retention system extends below a rear edge of the helmet shell such that the rear portion of the retention system is exposed and accessible to the user when wearing the helmet.

8. The helmet of claim 1, wherein the retention system further comprises at least one comfort pad at least partially surrounding at least one of the left and right first side straps.

9. The helmet of claim 1, wherein the retention system further comprises at least one comfort pad at least partially surrounding each of the left and right first side straps, and wherein the adjustment device is a lacing device, each elongated member is a lace, and the rear portion of the retention system comprises a padding material and a covering.

10. The helmet of claim 1, wherein the strap segment of each of the left and right first side straps comprises a continuous piece of material.

11. The helmet of claim 1, wherein the strap segment of each of the left and right first side straps moves with the respective elongated member as the length of the respective elongated member is adjusted.

12. The helmet of claim 1, further comprising:

left and right attachment straps extending from the rear portion of the retention system;

wherein the left and right attachment straps attach the rear portion of the retention system to the rear portion of the helmet shell;

wherein the left attachment strap and the right second side strap extend from opposite locations of the rear portion of the retention system; and wherein the right attachment strap and the left second side strap extend from opposite locations of the rear portion of the retention system.

13. The helmet of claim 1, wherein each of the second and third side straps are selectively adjustable independent from each of the first side straps.

14. A retention system for a helmet, comprising:

a rear portion of the retention system configured to be connected to a rear portion of the helmet;

at least one securing member configured to be attached to a front portion of the helmet;

at least one first side strap extending from the rear portion of the retention system to the front portion of the helmet, wherein the at least one first side strap comprises:

a strap segment extending from the rear portion of the retention system; and an elongated member movably attached to the strap segment via an attachment portion and extending from an adjustment device to the at least one securing member;

a means for selectively adjusting a length of the elongated member to move the strap segment relative to the helmet and along the elongated member, and to adjust a first side strap length of the at least one first side strap between the rear portion of the retention system and the front portion of the helmet by changing a distance between the strap segment and the at least one securing member;

a chin portion configured to receive a chin of a user;

left and right second side straps extending from the chin portion to the rear portion of the retention system, wherein a second side strap length of each of the left and right second side straps between the chin portion and the rear portion of the retention system is selectively adjustable; and left and right third side straps extending from the chin portion to left and right front portions of the helmet, respectively, wherein a third side strap length of each of the left and right third side straps between the chin portion and the left and right front portions is selectively adjustable.

15. A helmet including a helmet shell and the retention system of claim 14 attached to the helmet shell.

16. A retention system for a helmet, comprising:

a padded portion configured to be connected to a rear of the helmet;

at least one securing member configured to be attached to one of a left temple portion and a right temple portion of the helmet;

at least one first side strap extending from the padded portion to the respective one of the left temple portion and the right temple portion of the helmet, wherein the at least one first side strap comprises:

a strap segment extending from the padded portion; and a lace portion movably attached to the strap segment via an attachment portion and extending from an adjustment device to the at least one securing member, wherein the at least one securing member movably attaches the lace portion to the helmet;

a lacing device attached to the padded portion and configured to selectively adjust a first side strap length of the at least one first side strap between the padded portion and the respective one of the left temple portion and the right temple portion of the helmet, wherein the lacing device is configured to selectively adjust a length of the lace portion to move the strap segment relative to the at least one securing member and along the lace portion, and to adjust the first side strap length of the at least one first side strap between the padded portion and the temple portion of the helmet by changing a distance between the strap segment and the at least one securing member;

a chin portion configured to receive a chin of a user;

left and right second side straps extending from the chin portion to the padded portion of the retention system, wherein a second side strap length of each of the left and right second side straps between the chin portion and the padded portion is selectively adjustable; and left and right third side straps extending from the chin portion to the left and right temple portions of the helmet, respectively, wherein a third side strap length of each of the left and right third side straps between the chin portion and the respective left and right temple portions is selectively adjustable.

17. The retention system of claim 16, wherein:

the at least one first side strap comprises a left first side strap and a right first side strap, the left and right first side straps extending from the padded portion to the left and right temple portions of the helmet, respectively; and the at least one securing member comprises a left securing member and a right securing member configured to be attached to the left and right temple portions of the helmet, respectively.

18. The retention system of claim 16, wherein the lace portion is moved through the at least one securing member and the strap segment is moved toward the at least one securing member when the lace portion is retracted into the lacing device.

19. The retention system of claim 16, wherein the attachment portion comprises a tube attached to the strap segment.

20. A helmet including a helmet shell and the retention system of claim 16 attached to the helmet shell.

21. The retention system of claim 16, further comprising:

left and right attachment straps extending from the padded portion;

wherein the left and right attachment straps attach the padded portion to the rear portion of the helmet shell;

wherein the left attachment strap and the right second side strap extend from opposite locations of the padded portion; and wherein the right attachment strap and the left second side strap extend from opposite locations of the padded portion.

22. The retention system of claim 21, wherein each of the second and third side straps are selectively adjustable independent from the at least one first side strap.

23. A helmet, comprising:

a helmet shell; and a retention system attached to the helmet shell, the retention system comprising:

a rear portion connected to a rear of the helmet shell;

a left first side strap extending from the rear portion of the retention system to a left front portion of the helmet shell;

a right first side strap extending from the rear portion of the retention system to a right front portion of the helmet shell;

an adjustment device attached to the rear portion of the retention system and configured to selectively adjust a first side strap length of each of the left and right first side straps between the rear portion of the retention system and the left and right front portions of the helmet shell, respectively;

a chin portion configured to receive a chin of a user;

left and right second side straps extending from the chin portion to the rear portion of the retention system, wherein a second side strap length of each of the left and right second side straps between the chin portion and the rear portion of the retention system is selectively adjustable; and left and right third side straps extending from the chin portion to the left and right front portions of the helmet shell, respectively, wherein a third side strap length of each of the left and right third side straps between the chin portion and the left and right front portions of the helmet is selectively adjustable;

wherein each of the left and right first side straps comprises:

a strap segment extending from the rear portion of the retention system; and an elongated member attached to the strap segment and movable relative to the helmet shell; and wherein the adjustment device is configured to selectively adjust the elongated members of the left and right first side straps to move each of the strap segments relative to the helmet shell and adjust the first side strap length of each of the left and right first side straps between the rear portion of the retention system and the left and right front portions of the helmet shell, respectively; and wherein at least a portion of the left and right first side straps are configured to be tightened against a left side and a right side, respectively, of a head of the user, and the rear portion of the retention system is configured to be pulled forward and upward against a rear portion of the head of the user when the elongated members of the left and right first side straps are retracted into the adjustment device.

24. The helmet of claim 23, wherein:

the retention system further comprises at least one comfort pad at least partially surrounding each of the left and right first side straps;

the adjustment device is a lacing device;

each elongated member is a lace; and the rear portion of the retention system comprises a padding material and a covering.

* * * * *